United States Patent [19]

Minovitch

[11] Patent Number: 4,791,850

[45] Date of Patent: Dec. 20, 1988

[54] ELECTROMAGNETIC LAUNCHING SYSTEM FOR LONG-RANGE GUIDED MUNITIONS

[76] Inventor: Michael A. Minovitch, 2832 St. George St., Apt. 6, Los Angeles, Calif. 90027

[21] Appl. No.: 835,878

[22] Filed: Jan. 23, 1986

[51] Int. Cl.[4] ..... F41F 1/02

[52] U.S. Cl. ..... 89/8; 102/489; 124/3; 206/3; 244/3.2; 310/13

[58] Field of Search ..... 89/1.11, 1.1, 8, 1.8, 89/1.801, 1.803, 1.805, 1.809, 1.81, 33.04; 102/489, 37 A; 244/3.2; 124/3; 310/11-14, 10; 206/3

[56] References Cited

U.S. PATENT DOCUMENTS

| | | | |
|---|---|---|---|
| 2,870,675 | 1/1959 | Salisbury | 89/8 X |
| 2,972,286 | 2/1961 | Marquardt | 89/33.03 X |
| 3,126,789 | 3/1964 | Meyer | 124/3 X |
| 3,561,362 | 2/1971 | Black et al. | 102/374 |
| 4,311,081 | 1/1982 | Gillum | 89/33.04 |
| 4,343,223 | 8/1982 | Hawke et al. | 89/8 |
| 4,432,333 | 2/1984 | Kurherr | 89/8 X |
| 4,455,943 | 6/1984 | Pinson | 102/489 |

FOREIGN PATENT DOCUMENTS

| | | | |
|---|---|---|---|
| 2460507 | 1/1976 | Fed. Rep. of Germany | 124/3 |

OTHER PUBLICATIONS

E. H. Lemke, "Magnetic Acceleration of Interstellar Probes", Journal of the British Interplanetary Society, vol. 35, pp. 498-503, 1982.

"Inductance Calculations", Dover Publications, Inc., N.Y., Frederick W. Grover, pp. 94-113, 1946.

R. Gersdorf et al., "Design of High Field Magnetic Coils for Long Pulses", Review of Scientific Instruments, vol. 36, No. 8, pp. 1100-1109, 8/65.

S. Murase et al., "Properties and Performance of the Multifilamentary . . . ", IEEE Trans. on Magnetics, vol. 21, No. 2, pp. 316-319, 3/85.

R. DeMeis, "Every Guna Missile Launcher," Aerospace America, pp. 44-46, 6/85.

P. F. Walker, "Precision-Guided Weapons", Scientific American, vol. 245, pp. 37-45, 8/81.

J. P. Dawson et al., "Cryopumping Cryogenics", Cryogenics, vol. 5, No. 2, pp. 57-67, 4/65.

R. W. Boom, "Superconductive Energy Storage . . . ", IEEE Trans. on Magnetics, vol. 17, No. 1, pp. 340-343, 1/81.

R. S. Hawke et al., "Rail Accelerator Development for Ultra-High Pressure Research", IEEE Trans. on Mag., vol. 20, No. 2, Mar. 84.

*Primary Examiner*—Stephen C. Bentley

*Attorney, Agent, or Firm*—Christie, Parker & Hale

[57] ABSTRACT

An Earth-based, rapid-fire, electromagnetic accelerator system is provided for launching multiple hypervelocity nuclear or non-nuclear independently targetable warheads on ballistic trajectories to targets located anywhere on or above the Earth's surface. The warheads are mounted inside a reinforced launching sabot containing a plurality of coaxial superconducting dipole magnets. The sabot is magnetically accelerated to hypervelocities inside a large-bore vacuum tube by sequentially exciting a series of driving coils mounted coaxially along the tube. The sabots are injected into the tube from pre-evacuated storage canisters thereby eliminating the need for an air-lock. Terminal guidance systems allow the warheads to be fired over intercontinental distances to hit small, preselected targets with nearly perfect accuracy. The launch velocities are sufficiently high to enable warheads to also intercept and destroy orbiting satellites moving in space high above the Earth's surface.

60 Claims, 8 Drawing Sheets

ELECTROMAGNETIC LAUNCHING SYSTEM FOR LONG-RANGE GUIDED MUNITIONS

BACKGROUND

The usual method of accelerating a projectile to high velocities in a short distance is by means of a cannon. In this method, a charge of gunpowder is detonated behind a projectile in the cannon's breech and is instantly transformed into high pressure gas. This high pressure gas exerts a propulsive force on the end of the projectile thereby accelerating it through the barrel to high velocity. Unfortunately, the acceleration force decreases very rapidly as the projectile moves through the barrel. The maximum muzzle velocities are about 1 or 2 km/sec. Therefore, the maximum effective range of a conventional cannon is about 30 km.

Another method for accelerating a projectile is by means of an "electromagnetic launcher". In this method, electrical energy is transformed into magnetic energy which propels the projectile via magnetic forces. The advantage of this method is that the high initial force can be sustained all along the accelerator. This enables an electromagnetic accelerator to launch projectiles at velocities significantly higher than that achievable with conventional cannons. In fact, a long electromagnetic accelerator will be able to launch a projectile at orbital velocities. Thus, in theory, an electromagnetic launcher offers the possibility of unlimited range.

Unfortunately, electromagnetic accelerators designed for launching projectiles at hypervelocities must be evacuated in order to eliminate the disturbing effects of atmospheric drag. Of course, when operating in the vacuum of space, this is not a problem. But it is a very annoying practical problem when contemplating the design of Earth-based, rapid-fire, electromagnetic cannons for battlefield operations. In order for the accelerating tube to be evacuated, it must be sealed off from the outside atmosphere. In the prior art, this is accomplished by mounting a thin diaphragm over the muzzle of the tube and pumping out the air. The projectile is introduced into the launch tube by means of an air-lock and launched by breaking through the diaphragm. But every time a projectile breaks through a diaphragm, the vacuum inside the launch tube is destroyed. Thus, in order to launch a new projectile, a new diaphragm has to be mounted over the muzzle and the tube has to be reevacuated. This becomes a very tedious and time consuming problem when contemplating rapid-fire operations. This problem becomes even more severe when the tube diameter is increased because the time required to reevacuate the tube after each launching increases due to the increased volume. Consequently, prior-art electromagnetic launchers have very small bores, just a few centimeters in diameter, and are not very long. Thus, in order to achieve hypervelocities, the projectiles must have very low mass that are on the order of a few grams. But when such low mass projectiles are fired into the atmosphere at high velocities, deceleration by atmospheric drag is substantial. This limits the effective range and greatly reduces accuracy. Thus, the theoretical velocity advantages offered by electromagnetic launchers appear to be more than offset by the negative affects of atmospheric drag. According to the prior art, they can only reach their full potential when operating in a vacuum environment.

Most of the current research in Earth-based electromagnetic accelerators is focused on the development of so-called "railguns" for impact fusion, or for small calibre hypervelocity kinetic energy weapons for close-in point defense. Unfortunately, the electric-to-kinetic operating efficiency of hypervelocity railguns are inherently low (usually below 25%). Furthermore, in these launchers the projectiles are accelerated by maintaining sliding contact with two parallel rails which cause severe surface deterioration. This deterioration is so severe, the rails usually have to be replaced or resurfaced after only a few launches.

There is another class of electromagnetic accelerators called "coaxial launchers". These launchers are basically linear synchronous motors and are well known in the prior art. There is no physical contact between the object being accelerated and the accelerating tube. In some designs, the electric-to-kinetic operating efficiency can exceed 99%. Coaxial electromagnetic accelerators suffer no deterioration and can be used an unlimited number of times without breakdown. Unfortunately, the efficiency and overall performance of coaxial launchers is not very high for small calibre bores. Consequently, since both railgun and coaxial launchers require evacuated accelerating tubes when projectiles are accelerated to hypervelocities, hypervelocity coaxial launchers have usually been designed for operation in a vacuum environment such as in orbit, or on the Moon's surface. This is because it becomes too impractical to pump out a large calibre, high volume accelerator after each launching.

In summation, prior art hypervelocity electromagnetic launchers designed for operation within the Earth's atmosphere have inherently low electric-to-kinetic operating efficiency, small calibre bores, short range, poor accuracy, and very low repetition rates. These characteristics are clearly unsuitable for large calibre munitions and the practical demands of high accuracy, rapid-fire battlefield operations.

What is needed is an effective method for loading a projectile into an evacuated, large diameter, launch tube without going through the time consuming process of operating an air-lock, and a method for maintaining or rapidly reestablishing a hard vacuum inside the launch tube after a projectile is fired through it. The aim of this disclosure is to provide practical solutions to these problems and, in particular, to develop these solutions to provide a rapid-fire electromagnetic accelerator capable of launching large bore, guided projectiles with unlimited range and pin-point accuracy to destroy any target on Earth, or in orbit above it.

BRIEF SUMMARY OF THE INVENTION

With the foregoing in mind, the present invention provides a rapid-fire, long-range electromagnetic accelerating system for launching various types of single, or multiple independently targetable, high explosive or nuclear warheads on high-speed ballistic trajectories to targets located anywhere on, or above the Earth's surface. The warheads are mounted inside a reinforced launching sabot containing a plurality of coaxial superconducting dipole magnets. The sabot is magnetically accelerated to hypervelocities inside a large bore, evacuated launching tube by sequentially exciting a series of spaced apart driving coils mounted coaxially along the tube. This is accomplished by sequentially discharging a large bank of high voltage storage capacitors into the driving coils. This creates a traveling high intensity oscillating magnetic field, synchronized with the sabot's motion through the tube, that alternately pulls each sabot coil with attractive magnetic force as it approaches, and then pushes it away with magnetic repulsive force as it recedes. All of the superconducting dipole coils mounted on the sabot operate in tandem thereby distributing the total accelerating force along the entire length of the sabot as it moves through the accelerating tube.

The sabot is encapsuled inside an evacuated, thermally insulated, cryogenic storage canister that is transported to the launcher on an automated moving conveyor system. The sabot is fired directly from the storage canister by clamping one end of the canister to the accelerator, opening adjacent air-tight doors, and discharging the storage capacitors. After the sabot is launched, the doors are closed, the empty canister is unclamped, and the conveyor is moved taking away the empty canister and replacing it with a loaded canister. The reload and fire cycle time is about 20 seconds (or about 3 launches per minute).

An automatic high-speed diaphragm vacuum sealing system is mounted on the end of the launch tube for maintaining the vacuum inside the tube before a projectile is fired through it. The diaphragms are square, individually mounted between two flexible strips, and rolled up on a roll similar to motion picture film. After a projectile is accelerated through the launch tube, the roll is turned thereby positioning a new diaphragm across the end of the tube. An ultra high-speed shutter mechanism is mounted behind the diaphragm system which seals the tube with an air-tight door immediately after a projectile is launched thereby preventing any significant amount of air from entering the vacuum tube after the diaphragm is broken.

The multiple warheads are equipped with a terminal guidance system that allows small targets located many thousands of kilometers from the launcher to be hit with nearly perfect accuracy. This system comprises a miniaturized internal guidance system that sends steering commands to movable fins mounted on the end of the warheads. The launch velocities are sufficiently high to enable specially designed warheads to also intercept and destroy orbiting satellites or space stations at hypervelocities moving high above the Earth's surface.

In the preferred embodiment, the accelerating tube is 288 m (945 ft) long and has an inside diameter of 102 cm (40.16 in). The entire 288 m long accelerator, including the launch tube, drive coils, switching circuits, storage capacitors, and power conditioning systems, are rigidly mounted inside a rotatable spherical housing 310 m (1,017 ft) in diameter. This sphere is hermetically sealed and filled with pressurized helium gas at 1.0 Atm pressure to allow the accelerator to operate at very high voltages that would otherwise be impossible in an atmospheric environment because of atmospheric breakdown. This inner sphere is suspended on wheels that ride on a plurality of circular coaxial rails with a horizontal axis that are rigidly attached to the inside walls of an outer sphere 312 m (1,024 ft) in diameter. The outer sphere is suspended on wheels that ride on a plurality of circular coaxial rails embedded in bedrock with a vertical axis. Thus, the inner and outer spheres can be independently rotated about mutually perpendicular axes. The entire 288 m long accelerator can therefore be physically pointed to various directions by simultaneously rotating the inner sphere about its horizontal axis, and the outer sphere about its vertical axis. This unique mounting design also allows the tremendous impulsive recoil momentum, that is instantaneously generated by launching high mass sabots at hypervelocities, to be absorbed by the entire system including the two massive spheres (and the surrounding bedrock).

Approximately three-fifths of the outer sphere is mounted below ground level. The minimum elevation angle of the launch tube is 10° and it can be pointed to any direction in the sky above this minimum up to, and including the vertical 90° position with an accuracy of 0.1 seconds of arc ($4.8\times10^{-7}$ rad). Many circular tracks are used in both mountings to distribute the weight of the spheres uniformly around their respective surfaces. Both of the spheres are made of high strength structural steel with a skin thickness of 6 cm (2.36 in). The outer surface of the outer sphere is fitted with a 20 cm (7.87 in) thick jacket of high-strength, light-weight Kevlar for protective armor plating with a thin outer shell of mirrored aluminum to reflect hostile laser beams. The total gross weight of the system is on the order of 1,500,000 MT with most of the weight represented by the high energy storage capacitors. This high inertial mass is effectively utilized for absorbing the recoil effect generated by launching high mass sabots.

A large system for storing bulk electric energy is provided in a subterranean chamber excavated deep below the spheres. In the preferred embodiment, this energy storage system comprises a bank of inductive superconducting coils embedded in bedrock deep underground under the electromagnetic launcher. The total electrical energy storage capacity of this system is $10^{14}$ Joules. Assuming that the electromagnetic launcher has an overall electric-to-kinetic operating efficiency of 95%, this amount of stored electrical energy is sufficient to launch 1,000 sabots having a mass of 3,000 kg on long-range ballistic trajectories with launch velocities equal to 8 km/sec. This underground energy storage system allows the entire launching complex to be completely self-sufficient. Large storage facilities are also provided deep underground for storing thousands of sabots and various types of nuclear and non-nuclear guided munitions for fighting any type of military conflict including conventional or an all-out protracted nuclear war.

DRAWINGS

These and other advantages and features of the invention will be apparent from the disclosure, which includes the specification with the foregoing and ongoing description, the claims, and the accompanying drawings wherein:

Figure 24:
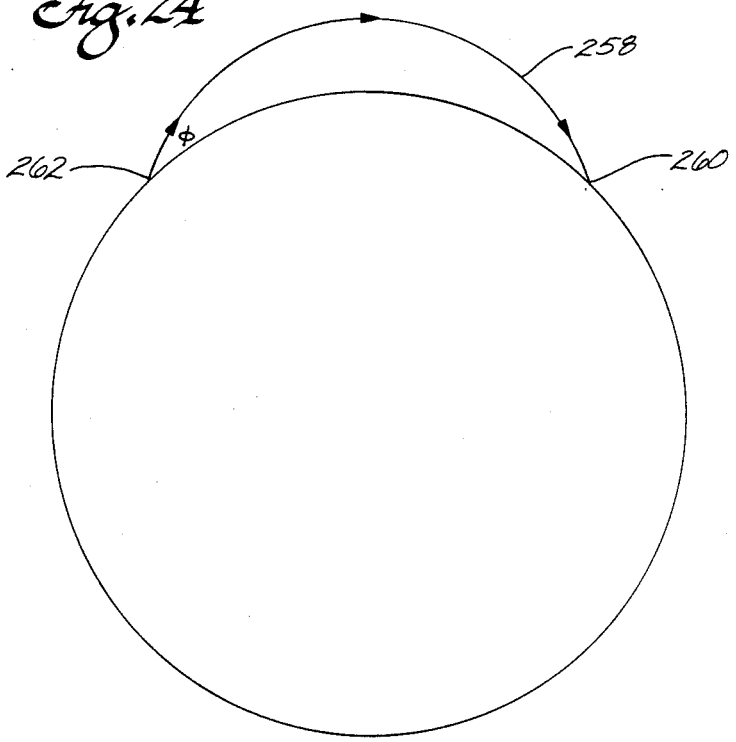
Figure 25:
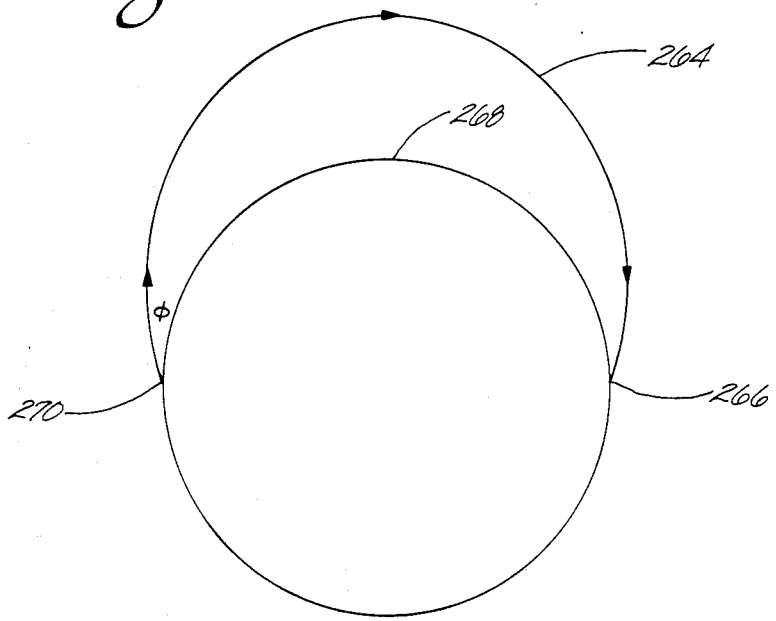

FIG. 24 illustrates the flight path of a projectile launched from an electromagnetic accelerator on a minimum energy ballistic trajectory to a target located 10,000 km from the launcher; and FIG. 25 illustrates the flight path of a projectile launched from an electromagnetic accelerator on a high energy ballistic trajectory to a target located at the maximum possible distance from the launcher 20,038 km (12,451 miles).

DESCRIPTION OF THE PREFERRED EMBODIMENT

The art of conducting successful warfare depends upon the ability to deliver warheads (either nuclear or non-nuclear) to preselected targets. Various weapon systems have been developed to accomplish this task. These include mortars, artillery, tanks, battleships, aircraft carriers, submarines, tactical aircraft, strategic bombers, and various short-range, intermediate range, and long-range ballistic missiles. Although all of these weapon systems are designed for special purposes, the intended result is always the same—the destruction of enemy targets.

Unfortunately, the application of any of these prior weapon systems is extremely costly. For example, the application of mortars, artillery and tanks by the U.S. Army on some remote battlefield thousands of kilometers from the United States, requires the mobilization and transportation of large numbers of soldiers with all of their equipment. The required logistical support needed to sustain this force over extended time periods is also very costly. The human cost in terms of battle casualties must also be considered. The application of U.S. Navel or Air Force weapon systems is also extremely costly. The application of long-range ballistic missiles is costly because, unlike the other weapon systems, the means for delivering the warheads (i.e., the various booster stages) are very expensive and not reusable. Furthermore, since intercontinental ballistic missiles require several minutes to build up to the required warhead release velocity, and emit huge amounts of heat during this acceleration period, they are vulnerable to attack by various space based weapon systems.

The purpose of the present invention is to provide a much more cost-effective, general purpose weapon system for launching various types of munitions with unlimited range, and with pin-point accuracy to any target on Earth—or in orbit above it. It is a single "super cannon" that can do the job of virtually every prior art stand-off weapon system in the entire U.S. Army, U.S. Navy and U.S. Air Force—ranging from non-nuclear mortars and light artillery, to ICBMs with multiple independently targetable nuclear warheads. By proper application, the raw fire power of this single weapon system can approach, and even surpass, the combined fire-power of all previous weapon systems. It can be made virtually invulnerable to attack, and the warheads it launches are virtually unstoppable. This weapon system is a large calibre, rapid-fire, long-range, coaxial discrete coil electromagnetic launcher using guided hypervelocity munitions and embedded partially underground near the summit of a high mountain located deep within the continental United States. The detailed design and construction of this giant electromagnetic cannon is described below.

In order to present a more systematic and comprehensive disclosure of the weapon system, I shall begin by setting forth the basic theoretical operating principles upon which it rests—namely the physics of discrete coil coaxial electromagnetic accelerators. This will also provide a means for designing the physical dimensions of the system so as to obtain a desired performance capability.

Figure 1A:
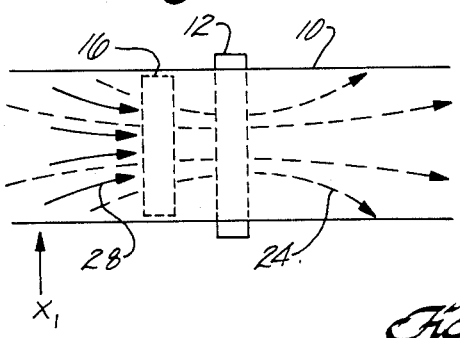
FIG. 1A is a schematic longitudinal view of a short tube section of the electromagnetic accelerator around one drive coil illustrating the magnetic attractive force exerted on an approaching superconducting dipole coil.
Figure 1B:
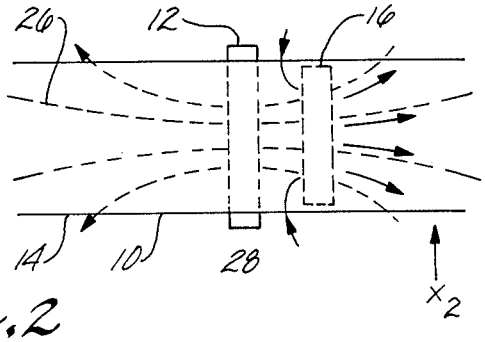
FIG. 1B is a schematic longitudinal view of a short tube section of the electromagnetic accelerator around one drive coil illustrating the magnetic repulsive force exerted on a receding dipole coil.
Figure 2:
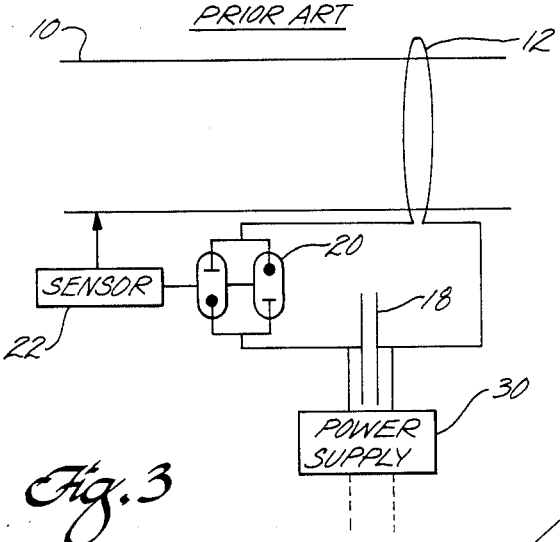
Fig. 2 PRIOR ART
FIG. 2 is a schematic circuit diagram illustrating the electrical operating principles of the electromagnetic accelerator.

FIGS. 1A and 1B are schematic longitudinal views through a short segment of an evacuated launch tube 10 in the vacinity of a single drive coil 12 mounted on a discrete coil coaxial electromagnetic accelerator 14 showing the relative positions of a single moving superconducting dipole coil 16 before and after it passes one stationary drive coil 12 respectively. There are several such superconducting dipole coils mounted coaxially along the launching sabot, and a much larger number of stationary drive coils mounted all along the accelerating tube. FIG. 2 is a simplified circuit diagram illustrating how the drive coil 12 is connected to a giant, high voltage capacitor 18 by means of a pair of ultra fast acting, ultra high current, antiparallel thyratron switches 20, that are triggered by a photoelectric position sensor 22. Referring to FIGS. 1A, 1B and FIG. 2, suppose that the dipole coil 16 is the leading dipole coil mounted on the sabot. Consequently, as the sabot approaches the drive coil 12, the photoelectric position sensor 22 is mounted such that it triggers the thyratron switches 20 at the exact instant the first dipole coil 16 reaches a predetermined position $x_1$ at time t=o. This action causes the capacitor 18 to discharge through the drive coil 12 thereby pulsing it with a very high current. This current pulse creates an intense magnetic field 24 that pulls the dipole coil 16 toward it with tremendous force. After time $t=\frac{1}{2}P_o$, where $P_o$ denotes the tuned LC oscillation period of the circuit given by the well known formula $$P_o=2\pi\sqrt{LC} \tag{1}$$

where L and C denote the inductance and capacitance of the circuit, the magnetic field becomes zero and the charge on the capacitor 18 reverses polarity. At this instant, the transverse mid-plane of the dipole 16 passes through the transverse mid-plane of the drive coil 12. Then, since the circuit remains closed, the capacitor 18 begins to discharge again through the drive coil 12. But since the polarity of the capacitor 18 is reversed, the current pulse through the drive coil 12 is reversed. Thus, the new magnetic field 26 of the drive coil 12 has a reverse direction. Since the polarity of the magnetic field 28 of the dipole coil 16 remains unchanged, the reversed magnetic field pulse generated by the drive coil 12, generates a tremendous repulsive force on the dipole coil 16 pushing it away. Thus, the drive coil 12 first pulls the dipole coil 16 toward it as it approaches, and then pushes it away repulsively after it passes. This pull-push effect doubles the time and distance which each drive coil accelerates each dipole coil. The transverse mid-plane of the dipole coil 16 reaches point $x_2$ at time $t=P_o$. At this instant, the oscillating magnetic field of the drive coil 12 is zero and the capacitor 18 is recharged with the same initial polarity it had at time t=o when the dipole coil 16 was at point $x_1$. Thus, the effective distance over which the drive coil 12 acts on the dipole coil 16 is equal to the distance d between point $x_1$ (when t=o) and $x_2$ (when $t=P_o$) shown in FIGS. 1A and 1B. Thus, the various drive coils mounted along the accelerator tube have a uniform spacing which is equal to d. (The spacing d is equal to the distance between the transverse mid-planes of adjacent drive coils).

If no provision is made, the voltage across the capacitor 18 at the beginning of each new cycle will be lower than the voltage of the preceding cycle. This voltage drop represents a decrease in electrical energy that is converted into kinetic energy of the dipole via the pull-push action of the drive coil. (The efficiency of this energy conversion process can be close to 100%.) If the circuit is left unchanged, the electrical energy initially stored in the capacitor 18 would gradually run down to zero by giving it to passing dipole coils. Thus, as is shown in the circuit diagram of FIG. 2, each separate oscillating drive coil-storage capacitor system is equipped with a secondary power supply 30 which is designed to restore the initial voltage to the primary storage capacitor 18 after each oscillation.

Let $\bar{u}$ denote the average dipole velocity between $x_1$ and $x_2$, and let R denote the mean drive coil radius. Omitting the analytical analysis, it has been shown that if the ratio $P_o\,\bar{u}/R=4$, then the total energy $\Delta E$ gained by the dipole coil 16 as is passes by the drive coil 12 while moving from $x_1$ to $x_2$ is nearly maximum and given by the formula $$\Delta E=1.28B_mM \tag{2}$$

where $B_m$ denotes the maximum magnetic field strength of the drive coil 12, and where M denotes the dipole moment of the dipole coil 16. (See equation (11) of the paper, "Magnetic Acceleration of Interstellar Probes," *Journal of the British Interplanetary Society,* Vol. 35, pp. 498–503, 1982 by E. H. Lemke.) Consequently, since $\bar{u}=d/P_o$, it follows that $d/R=P_o(\bar{u}/R)=P_o(4/P_o)=4$. Thus, the spacing d between adjacent drive coils will be designed to be 4R.

Let r denote the mean radius of the dipole coil 16. Thus, since M=enclosed area×total current intensity I, $M=\pi r^2 I$, and it follows that $$\Delta E=4.02B_mr^2I \tag{3}$$

Since r<R, it is clear from this equation that $\Delta E$ will have a maximum value when r=R. Obviously since this is a physical impossibility (since the dipole coil must pass through the drive coil), the accelerator will be designed such that the mean radius r of the dipole coils are slightly less than the mean radius R of the drive coils. (This will maximize the inductive coupling between the coils.). It is also apparent that in order for r to be large, the mean radius R of the drive coils should also be large. Thus, the accelerator tube should be designed with a large bore.

In a freely oscillating LC circuit as is shown in FIG. 2, (neglecting the dipole coil) the electric field energy of the capacitor 18 is transformed into the magnetic field energy of the inductor (which is the drive coil 12) and vice-versa. Hence $$\tfrac{1}{2}CV_m^2=\tfrac{1}{2}LI_m^2$$

where $V_m$ is the maximum voltage across the capacitor and $I_m$ is the maximum current passing through the inductor. Consequently, in view of equation (1), it follows that $$P_o=\frac{2\pi LI_m}{V_m} \tag{4}$$

In order for the oscillations to be synchronized with a passing dipole coil, the period $P_o$ must be equal to the time it takes the dipole coil to travel from $x_1$ to $x_2$. Since the distance between $x_1$ and $x_2$ is equal to d, it follows that $P_o = d\sqrt{u}$. Consequently, in view of equation (4), and since d=4R, it follows that $$V_m = \frac{\pi L I_m u}{2R} \tag{5}$$

This equation is important because it gives the synchronizing functional relationship between the maximum required voltage $V_m$, and current $I_m$, corresponding to a drive coil with mean radius R and self inductance L, and a dipole coil moving past it with average velocity $\bar{u}$. When the velocity of the dipole increases, the maximum required voltage increases in direct proportion. Thus, in order to obtain maximum launch velocities with minimum voltage, the drive coils will be designed with minimum self inductance L.

The self inductance of a solenoid with a rectangular coil cross section having a mean radius R, length l, and thickness (coil width) w, can be expressed analytically by the equation $$L = 1.67\mu_o N^2 R[R/(l+w)]^{\frac{3}{4}} \tag{6}$$

where N denotes the number of turns in the coil. (See, F. Kohlrausch, *Praktische Pysik II*, B. G. Teubner, Stuttgart, 1962, p. 337; and *Inductance Calculations*, Dover Publications, Inc., New York, 1946, pp. 94–113, F. W. Grover). Since this equation shows that in order to obtain a low value of L, the drive coils should have only one turn. Thus N=1. Therefore, the maximum current intensity $I_m = J_m\, l_1 w_1$ where $J_m$ denotes the coil's maximum current density. Upon substituting this relationship for $I_m$, and the function for L given in equation (6), into equation (5), one obtain $$V_m = 2.62\mu_o J_m l w_1 \left(\frac{R}{l + w_1}\right)^{\frac{3}{4}} \bar{u} \tag{7}$$

This equation is important when considering the detailed design of the drive coils. For example, for fixed values of the coil's mean radius R, cross sectional area $A = l_1 w_1$, and maximum current density $J_m$, the required peak voltage $V_m$ across the storage capacitor can be varied by simply varying the values of $l_1$ and $w_1$. Since this voltage is maximum when $l_1 = w_1$ (i.e., for a square coil cross section) the drive coils will be designated with rectangular cross sections that are not square. However, the length $l_1$ will be equal to the length $l_2$ of the dipole coils.

Perhaps the most important equation in the design of discrete coil coaxial electromagnetic accelerators of the type considered herein is the force equation because this equation determines the launch velocities corresponding to various design parameters. This equation can be derived as follows: Referring to FIGS. 1A and 1B, let $\bar{F}$ denote the average magnetic force (attractive and repulsive) exerted on the dipole coil 16 by the drive coil 12 as it moves from $x_1$ to $x_2$. Then, since the energy gained by the coil is $\Delta E$, it follows that $\Delta E = \bar{F}d$ where d is the distance between $x_1$ and $x_2$. Hence, in view of equation (3)

$$\bar{F} = \frac{4.02 B_m r^2 I}{d} \tag{8}$$

The maximum magnetic field strength $B_m$ at the center of the solenoidal drive coil can be expressed analytically to a good approximation by the equation $$B_m = \tfrac{1}{2}\mu_o J_m l \log\left(\frac{2R + w}{2R - w}\right) \tag{9}$$

(See, R. Gersdorf, et al., "Design of High Field Magnet Coils for Long Pulses, "*Review of Scientific Instruments*, Vol. 36, No. 8, Aug. 1965, pp. 1100–1109).

Assuming that the superconducting dipole coil has a rectangular cross section with length $l_2 = l_1 = l$, and width $w_2$, then $I = J\, l w_2 p$ where J is equal to the current density (amp/m$^2$) of the superconducting conductor used in the coil. The term p is equal to the coil's packing fraction and is equal to the volume occupied by the coil's conductor divided by the coil's total volume. Consequently, after substituting the expression for $B_m$ in equation (9) and setting d=4R, the force equation can be expressed as $$\bar{F} = 0.503 p\mu_o J_m J l^2 w_2 \log\left(\frac{2R + w_1}{2R - w_1}\right)\left(\frac{r^2}{R}\right) \tag{10}$$

This equation shows that for any fixed value of R, the average accelerating force $\bar{F}$ increases according to the square of the mean dipole radius r. Consequently, since the absolute upper limit of this parameter is R, the dipole coil should be designed to have a mean radius r as close to R as possible. Therefore, the mean radius of the drive coils themselves should be as large as possible. (This conclusion was also obtained from equation (3)). Since the required peak voltage $V_m$ increases as $R^{\frac{3}{4}}$, increasing R will not cause a steep increase in $V_m$. However, when r increases, the total inertial mass of the dipole will increase also. If the increase in the dipole's inertial mass cannot be offset by the increased magnetic forces, the dipole's acceleration would not be increased. Thus, the design of the acceleration system should be based on maximizing the accleration of a single dipole coil without any sabot.

Let $\rho$ denote the dipole's average mass density. Consequently, if m denotes the dipole's mass, $m = 2\pi r l w_2 \rho$. Thus, since $\bar{a} = \bar{F}m$, the force equation (10) can be used to obtain the acceleration equation:

$$\bar{a} = 0.0801(p/\rho)\, \mu_o J_m J l \log\left(\frac{2R + w_1}{2R - w_1}\right)\left(\frac{r}{R}\right) \tag{11}$$

This equation is important because it shows that the dipole's acceleration is independent of its coil thickness $w_2$. Increasing this parameter will not increase its acceleration. Thus, for any given value of $J_m$ and J, the most important parameters affecting $\bar{a}$ are coil length l, drive coil thickness $w_1 1$, and the ratio $p/\rho$. Since the factor (r/R) increases whe the dipole coil's thickness $w_2$ decreases, $w_2$ should be small relative to l. However, in view of the voltage equation (7), increasing l and $w_1$ will also result in increasing $V_m$ which is undesirable.

In order to maximize the ratio $p/\rho$, the superconductor of the dipole coil should have a low mass density. The insulating material should also have a low mass density. It should also have a high tensile strength in order to provide structural support to counter the high magnetic pressure which is equal to $B^2(2\mu_o)$. Consequently, by using a superconductor with superconducting filaments embedded in an aluminum stabilizer, the dipole's superconductor mass density can be assumed to be 5,000 kg/m$^3$ (5.0 gm/cm$^3$). High strength fused-silica glass fiber composite material will provide excellent insulation because it has a mass density of only 2,160 kg/m$^3$ and its tensile strength is $1.4\times10^{19}$ N/m$^2$. Consequently, the average mass density $\rho$ of the superconducting dipole coil can be expressed as $\rho=5000\,p+2160(1-p)$. Therefore $$p/\rho=[2840+(2160/p)]^{-1}$$

Since this ratio increases as $p\rightarrow1$, it follows that the packing fraction p should be as high as possible.

In the above cited paper by Gersdorf, a value of 0.85 was taken for large solenoids generating magnetic fields in excess of 40 T. Hence, in order to be conservative, the packing fraction will be assumed to be equal to 0.85. Thus, $p/\rho=1.858\times10^{-4}$ kg/m$^3$ and $\rho=4{,}574$ kg/m$^3$.

Rather than going into a detailed parametric analysis involving determining optimum values of l, $w_1$, $w_2$, and r corresponding to certain values of R, the design of the accelerator presented herein will be based upon a few simple observations involving the energy equation (3), the peak voltage equation (7), and the acceleration equation (11). First of all, it is clear from the energy equation (3) that since $r<R$, the value of R should be as large as possible so that r can be large. Secondly, since the variable factor $lw_1/(l+w_1)^2$ appearing in the voltage equation (7) becomes maximum when $l=w_1$ (for any given coil cross section area $lw_1$) it follows that the proper design of the drive coils should be such that $l>w_1$, or $l<w_1$. In view of equation (11) however, it is clear that the preferred design should be such that $l>w_1$. Furthermore, in order to enable r to be close to R, $w_2$ should be relatively small. (But $w_2$ should not be too small because this would introduce excessively high sheering stress on the sabot's structure.)

Since any optimization analysis of these coil parameters is beyond the intended scope of this application, I shall simply give these parameters the following values:

| | | |
|---|---|---|
| R = 0.60 m | $l_1$ = 0.30 m | $\omega_1$ = 0.14 m |
| r = 0.48 m | $l_2$ = 0.30 m | $\omega_2$ = 0.04 m |

These numerical values determine the size and shape of all the drive coils and dipole coils. The gap between the inside lateral surface of the drive coils, and the outside lateral surface of the dipole coils will be 3 cm (1.18 in). This gap will contain the vacuum tube and the guide sheets (for maintaining transverse stability).

Since the separation distance d between the transverse mid-planes of adjacent drive coils is equal to 4R, and since R=0.60 m, this separation distance will be equal to 2.40 m (7.67 ft).

If the current density J of the superconductor making up the dipole coil is assumed to be $10^9$ amp/m$^2$, then since the packing factor p=0.85, the average current density $\bar{J}=Jp=8.5\times10^8$ amp/m$^2$. Consequently, the resulting magnetic field strength at the dipole's center can be calculated from equation (9) with the current density equal to $7.5\times10^8$, R=0.48, w=0.04, and l=0.30. The result is B=13.36 T. Since these are reasonable values for state-of-the-art superconductors, this wil be the current density taken for the dipole coils. (See, "Properties and Performance Of The Multifilamentary $Nb_3Sn$ With Ti Addition Processed By The Nb Tube Method," *IEEE Transactions on Magnetics,* Vol. MAG-21, No. 2, March 1985, pp. 316–319, by S. Murase et al.)

In order to increase the electrical conductivity of the drive coils 12, they will be cryogenically cooled to liquid nitrogen temperatures. This will also reduce ohmic power losses and increase the overall operating efficiency. Thus, with this cooling system, and since the pulse duration will be very short (on the order of 50 microseconds for the last coils) the maximum current density $J_m$ for the drive coils can be assumed to be $5.0\times10^8$ amp/m$^2$. This is a reasonable value for state-of-the-art cryogenically cooled pulse coils. The corresponding maximum pulsed magnetic field strength $B_m$ will be 22.09 T. In order to count the high mechanical stress generated by this high magnetic field, the drive coils will be reinforced with thick cylinders of high strength fused-silica glass fiber composite material.

This drive coil current density of $5.0\times10^8$ amp/m$^2$ will be assumed to be the highest that will be generated by the accelerator. Thus, the accelerator presented herein will be well within the current state-of-the-art.

Since the dipole's superconductor current density J is assumed to be constant (and equal to $10^9$ amp/m$^2$) it follows from equation (10) that the accelerating force $\bar{F}$ varies in direct proportion with $J_m$. Consequently, by changing $J_m$, the total accelerating force acting on the coil can be changed. Since the electronic control system required to change $J_m$ is much simpler than that required to change the current density J in the superconducting dipole coils (after they are mounted in launching sabots), the design of the electronic control system that controls the accelerating force will be based on controlling $J_m$. Therefore, since the length of the accelerator is fixed, the launch velocity u of a sabot having a certain mass will be controlled by controlling $J_m$.

For maximum performance, $J_m=5.0\times10^8$ amp/m$^2$ and the resulting accelerating force $\bar{F}$ acting on a dipole will be $1.18\times10^8$ N ($2.66\times10^7$ lbs or 13,311 tons). This force is comparable to the impulsive force generated inside the breech of a large calibre cannon at the instant it is fired. But in the proposed electromagnetic cannon, this enormous accelerating force is continued all along the accelerator tube by the various drive coils. Therefore, by designing a long accelerator, it will be possible to achieve extremely high launch velocities—much higher than conventional cannons. The only practical limit on launch velocity u will be that imposed by the maximum possible voltage $V_m$ that could be applied to the discharge capacitors 18.

Figure 3:
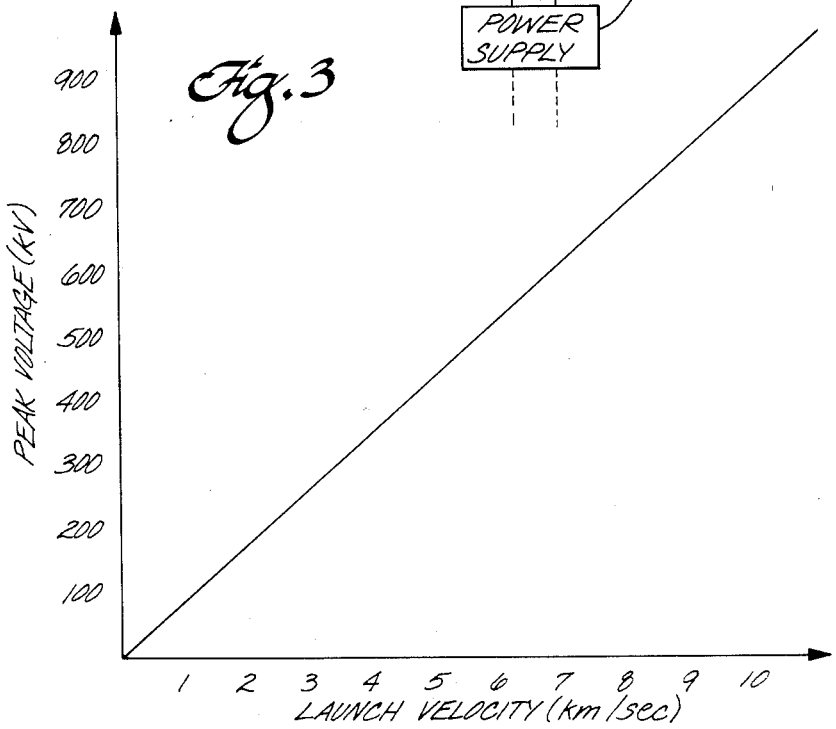
FIG. 3 is a graph of maximum voltage $V_m$ versus launch velocity u corresponding to the proposed electromagnetic launcher.

FIG. 3 is a graph of $V_m$ versus launch velocity u given by equation (7) using the numerical values for the various design parameters given above. For a launch velocity of 8,000 m/sec, $V_m$=698 kV. This voltage is well within engineering feasibility. But a launch velocity of 8,000 m/sec would give this electromagnetic cannon unlimited range. Hence, every point on the Earth's surface will be within firing distance.

The accelerator can be designed to have any length desired by simply making the launch tube longer, and adding on more drive coils. For example, suppose that there are n drive coils. As was demonstrated above, these drive coils exert a tremendous force on a passing dipole coil. At the exact instant $t_i$ ($i=1,2,\ldots,n$) that the mid-plane of the dipole coil 12 crosses each point $x_i$ the corresponding thyratron switches are closed sequentially, thereby generating a precisely synchronized traveling magnetic field that continuously accelerates the dipole with tremendous force all along the launch tube.

If the superconducting dipole coil were the only object moving through the accelerator tube, its average acceleration $\bar{a}$ is given by equation (11) wherre $(p/\rho)=1.858\times10^{-4}$ $m^3/kg$. Consequently, $a=5.96\times10^5$ m/sec$^2$ (60,811 gee). The total mass of the coil is $2\pi rlw_2\rho=165$ kg.

Let s denote the length of the accelerating portion of the launch tube. The launch velocity u can be calculated by $$u=\sqrt{2sa} \tag{12}$$

Thus, in order to achieve a launch velocity of 8,000 m/sec, the accelerating tube would be have to be 53.7 m (176 ft) long. Since this example corresponds to the case of zero sabot mass and zero payload mass, this length represents a lower bound on the required accelerator length. Since the accelerator will have to be movable so that it can be pointed in various directions, the actual design length will be determined by the longest practical length possible that can be mounted on a movable platform. In view of the tremendous catapulting force that will be generated by this system, this mounting problem presents a major engineering design problem that is not easily solved. The solution presented herein thereform represents an important design feature of the proposed weapon system. This solution is important because it will allow the accelerator to be extremely long and easily pointed in any direction. The detailed design of this movable mounting system will be disclosed later.

In the preferred embodiment, the accelerating portion of the launch tube will have a length of 288 m (945 ft) and 120 separate and independently operating drive coils. Thus, according to equation (12) the maximum launch velocity of a single dipole coil will be 18,528 m/sec. This velocity is much higher than would be needed in any practical situation since Earth escape velocity is only 11,200 m/sec. Consequently, the launch sabot, on which the coil is mounted, can have a considerable amount of structural and payload mass before the launch velocities drop below the required minium—which is 8,000 m/sec. This relatively large amount of mass that can be allocated to the sabot structure will be used for making it superstrong in order to be able to withstand the enormous acceleration forces. In order to determine the actual performance capabilities of the system, it is necessary to consider the design and construction of the launch sabot, and how much mass can be set aside for the payload.

As described above, the superconducting dipole coil 16 is mounted around the launch sabot which contains the actual payload. Consequently, by mounting a plurality of dipole coils coaxially around the launch sabot such that they operate in tandem, the total accelerating force will be multiplied by the number of dipole coils. In order for the dipole coils to operate in tanden, they must have the same longitudinal spacing as the drive coils. This tanden, force multiplying, design can be understood by referring back to FIGS. 1A and 1B.

Suppose that the lead dipole on the sabot passes the drive coil 12 and is at position $x_2$ shown in FIG. 1B. At this instant, the second dipole is at point $x_1$. But as described above, the oscillating LC circuit is tuned such that when the lead dipole is at $x_2$, the state of the drive coil 12 automatically returns to the state it had when the first dipole was at point $x_1$. Thus, the second dipole coil is pulled toward, and then pushed away from the drive coil 12 just as in the case of the first dipole coil. Likewise, the third, fourth and all following dipole coils mounted on the sabot are pulled toward, and then pushed away from the drive coil 12 as each of then passes by, one after another.

Since the sabot is being continuously accelerated as it passes the drive coil 12, the time intervals $\Delta t$ required for each dipole coil to traverse the distance from $x_1$ to $x_2$ progressively decreases. Consequently, the intermediate power supply 30 is designed to slightly increase the voltage across the capacitor 18 after each oscillation in accordance with equation (9) in order to synchronize the oscillations with the accelerating dipole coils mounted on the sabot that move past the drive coil 12 in rapid succession. Thus, the time interval $P_o$ of each individual oscillation is progressively decreased in order to maintain proper phase for maximizing the pull-push effect on each passing dipole mounted on the sabot.

At the instant the last dipole coil on the sabot passes point $x_2$, the thyratron switches 20 are triggered which opens the LC circuit of the drive coil 12 terminating the oscillations. The energy remaining in the capacitor 18 can then be used for the next launch, or it may be returned to the prime electrical storage system. It may also be transmitted to other capacitor banks further along the launch tube ahead of the moving sabot. This pull-push process takes place at all 120 drive coils mounted along the launch tube.

Figure 4:
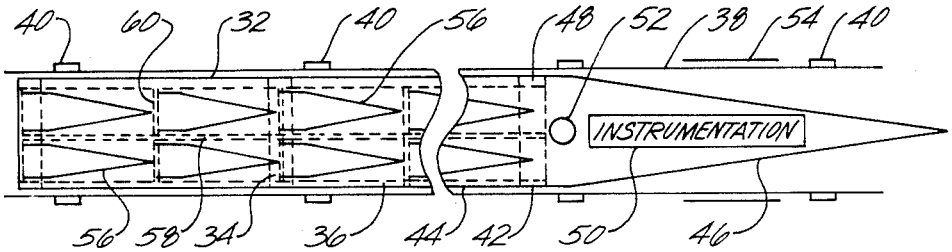
FIG. 4 is a schematic longitudinal cross section of a reinforced launching sabot containing a plurality of superconducting dipole coils and a central munitions canister containing a plurality of independently targetable guided warheads.
Figure 5:
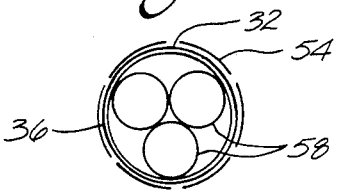
FIG. 5 is a schematic transverse cross section of a reinforced launching sabot containing a plurality of superconducting dipole coils and a central munitions canister containing a plurality of independently targetable precision guided warheads.

FIGS. 4 and 5 are schematic longitudinal and transverse cross sections illustrating the design and construction of a launching sabot 32 containing multiple dipole coils 34 and a central munitions canister 36 which represents the payload. The sabot 32 is shown accelerating through a launch tube 38 driven by a plurality of coaxial drive coils 40.

As described above, the sabot 32 is constructed with light-weight superstrong fused-silica glass fiber composite material. This material is ideal because its density $\rho$ is only 2.16 gm/cm$^3$ but its tensile strength $\tau=1.4\times10^6$ N/cm$^2$. Hence, the ratio $\tau/\rho=6{,}481$ Joules/gm. It is important to estimate how much mass can be allocated to the construction of the sabot and how much mass can be allocated to the payload. Before this can be determined, it is necessary to determine the maximum total mass $M_o$ that a single dipole coil can accelerate to the minimum required launch velocity u=8,000 m/sec. This calculation can be obtained from the equation $$M_o=\frac{2s\bar{F}}{u^2} \tag{13}$$

Since the maximum acclerating force $\bar{F}$ acting on a single dipole was determined to be $1.18\times10^8$N and since s=288 m, the total mass $M_o$ that each dipole coil can accelerate to 8,000 m/sec is 1,065 kg. Since the mass of the dipole coil itself is only 165 kg, the total mass that can be divided between sabot structure and payload is 900 kg. However, a typical launch sabot, such as the one shown in FIG. 4, will be several meters long and propelled by a plurality of dipole cells. For example, suppose that the sabot is equipped with 8 dipole cells. Consequently, assuming that the desired launch velocity u=8,000 m/sec, the total mass will be $8\times1{,}065$ kg=8,520 kg (18,783 lbs), and the total accelerating force will be $8\times1.18\times10^8$ N=$9.44\times10^8$ N. The distance between the front of the first coil and the end of the last coil will be 17.1 m (56.1 ft). The total launch force will therefore be distributed (essentially uniformly) over a long reinforced structure and maintained for a distance of 288 m. In conventional cannons, all of the driving force is concentrated on the transverse rear surface of the projectile and extends for only a short distance along the barrel—and decreases very rapidly as the projectile moves through it.

Since the total dipole mass will be $8\times165$ kg$\times1{,}320$ kg, the combined mass of the sabot structure and payload canister will be 7,200 kg. Assuming that the combined structural mass of the sabot and payload canister is 2,170 kg and if the mass of the various internal electronic control systems (including an attitude control moment gyro system) is 30 kg, then the payload available for warheads will be 5,000 kg (11,023 lbs). This warhead payload mass represents the effective "throw-weight" of the proposed electromagnetic cannon. It is significantly greater than that of the MX missile which is the most powerful ICBM in the U.S. strategic arsenal—and each one costs $50 million.

In order to demonstrate that this amount of material should be sufficient to provide the sabot with the necessary reinforced structure support, it should be pointed out that the total launch force of $9.44\times10^8$N can be supported (in tension) by a single beam of glass composite with a diameter of only 29.3 cm (12 in). Moreover, the total force acting on the sabot is not concentrated at one local region, but is distributed along the length of the sabot by the eight dipole coils. Thus, referring to FIGS. 4 and 5, the detailed structural design of the sabot will include eight thick-walled, circular composite thrust rings 42 surrounding the eight dipole coils 34. These rings 42 are embedded in a relatively thick cylindrical jacket 44 of composite material that forms the outer wall of the payload canister 36. This jacket 44 is fabricated with composite fibers, woven in a special pattern to bear maximum longitudinal stress.

The launch sabot 32 is also provided with a streamlined protective nose cone 46 extending around the forward circumferential periphery of the leading dipole coil 48 with a very low drag coefficient. This nose cone 46 runs from the leading dipole 48 and extends forward a distance of 3 m. It has a semi-angle $\theta$ of 9.5° and a drag coefficient of about 0.03. It is constructed with a high-strength, high-temperature composite material such as graphite-fiber or carbon-carbon which is designed to slowly ablate while passing through the atmosphere.

Most of the flight instrumentation 50 is mounted inside the nose cone 46. A very accurate attitude control moment gyro system 52 is also mounted inside the nose cone 46 which keeps the longitudinal axis of the launch sabot aligned with its velocity vector as it traverses through the atmosphere.

The sabot has an overall length of 19.1 m (62.7 ft) and a diameter of 1.0 m (39.4 in). Hence, it has a length-to-diameter aspect ratio of 19.1:1. The average acceleration of the sabot corresponding to a launch velocity of 8,000 m/sec will be $1.11\times10^5$ m/sec$^2$ or 11,339 gee. This acceleration is well below that of guided projectiles fired from conventional cannons and nuclear artillery shells.

As the sabot is accelerated through the launch tube, it is maintained precisely in the center of the tube by a passive repulsive magnetic guidance system built into the walls of the tube. As is shown in FIGS. 4 and 5, this system comprises six separate curved sheets of aluminum 54 mounted coaxially and extending along the entire tube. The magnetic field of the moving sabot coils induces strong eddy currents in the aluminum sheets which create repulsive magnetic fields that are the mirror image of the external dipole fields. When one side of the sabot approaches too close to the tube wall, these repulsive magnetic forces increases, thereby keeping the sabot perfectly centered along the tube's longitudinal axis. Since the sabot moves through the tube with high velocities, the magnetic drag will be very low, but the repulsive forces very high. Thus, the sabot is accelerated through the launch tube without being in physical contact with the inside walls.

In order to emphasize the destructive power of the proposed electromagnetic launcher, the payload shown in FIGS. 4 and 5 consists of 48 individually targetable nuclear warheads 56 (100 KT type) each weighing 104 kg (229.7 lbs). The warheads 56 are mounted inside three parallel composite cylinders 58 with 16 warheads in each cylinder. Each warhead is 1 m long and separated from each othr by thick walled transverse bulkheads 60 which are also made of composite material. At the appropriate time (prior to apogee) the nose cone 46 separates from the sabot and the warheads 56 are released to follow their own separate trajectories to their designated targets.

Other payloads could consist of self-guided high explosive warheads. Special munitions would be carried to carry out special tasks. The launcher could be used in localized conflicts with many different types of non-nuclear warheads. For example, suppose Libya is invading one of its neighbors with a fleet of 100 tanks. In this case, one canister could be launched with 100 individual self-guided hypervelocity, anti-tank submunitions which could simultaneously destroy the entire fleet. In another situation, suppose a fleet of 50 naval vessels are engaged in hostile action on some remote sea. The entire fleet could be sunk or severely damaged by special purpose self-guided munitions launched from one canister. The kinetic energy of a 50 kg projectile reentering the atmosphere and hitting a target, at say 8 km/sec, would deliver $1.6\times10^9$ Joules of destructive energy that could easily sink or severely damage the largest warships—would carrying any explosive warhead. The effect would be equivalent to a direct hit by a large solid meteorite.

The detailed design and construction of self-guided munitions are well known within the prior art of U.S. weapons development and will not be discussed in this application. However, the use of self-guided munitions is considered to be an integral part of the electromagnetic launcher disclosed herein. For detailed information on self-guided munitions, see the articles: "Every Gun a Missile Launcher," *Aerospace America,* June 1985, pp. 44–46 by R. DeMeis; and "Precision-Guided Weapons," *Scientific American,* Aug. 1981, Vol. 245, pp. 37–45, by P. F. Walker.

The canister could also carry multiple, anti-satellite, guided missiles with onboard propulsion systems for terminal guidance. Since launch velocities in excess of 12 km/sec could be provided, this ASAT application represents a valuable feature. Closing velocities in excess of 7 km/sec would make these small SAT missiles impossible to stop. As they approach a target satellite, they could detonate sending a shower of thousands of small steel pellets at the satellite like a giant 12-gauge shotgun. Since it would be relatively easy to mount 12 independently targatable self-propelled, ASAT missiles in a single payload canister, it would be possible to simultaneously destroy 12 separate enemy satellites and space stations by launching one ASAT sabot. Since the electromagnetic cannon will have a very rapid reload and fire capability (3 sabot launches per minute in the preferred embodiment) it will be possible to destroy every single Soviet satellite within a period of just a few minutes.

There are also many peaceful applications that the launcher could be used for. For example, the launcher could be used to permanently dispose of radioactive waste material by launching it on Earth escape trajectories. Thus, the proposed electromagnetic cannon could perform a valuable service even in peace time.

By using well known mass production techniques, the superconducting dipole coils and sabots could be manufactured on a mass production basis thereby reducing the total unit cost to very low levels.

As pointed out above, one of the most important design features of the proposed electromagnetic cannon is the movable mounting platform. Unless the accelerator can be physically moved and pointed in various directions, it could not be used against targets in different locations. However, in view of the tremendous recoil forces that will be generated by the accelerator, the design of the movable mounting platform does not exist in the prior art. Furthermore, the sheer magnitude of the accelerator's mass (especially the high voltage storage capacitors) will be enormous. For example, a sabot mass of 8,520 kg accelerated to 8,000 m/sec has a launch energy of $2.73\times10^{11}$ Joules—and, as calculated above, the impulsive recoil force will be $9.44\times10^{8}$N (106,115 tons). The mass and volume energy densities of state-of-the-art high voltage storage capacitors is 300 Joules/kg and $3.5\times10^{5}$ Joules/m$^3$ respectively. Therefore, assuming an electric-to-kinetic operating efficiency of 95%, the required mass and volume of the accelerator's capacitor bank will be 955,000 MT and 817,000 m$^3$ respectively. Thus, the total mass of the accelerator is comparable to that of a fully loaded supertanker. The magnitude of the engineering problem is therefore comparable to designing a mounting platform for a supertanker that will enable it to be physically moved and pointed in any direction desired.

The design strategy for the accelerator's mounting platform disclosed herein is based upon utilizing the accelerator's enormous inertial mass to absorb the enormous recoil force. Thus, the drive coils which are positioned coaxially around the accelerating tube are not rigidly mounted on the tube. Rather, they are positioned around the tube but mounted on, and anchored to, a massive steel frame on which the entire accelerator is rigidly mounted. Therefore, no recoil forces will be exerted on the launch tube itself (which will be relatively fragile). The recoil force will be absorbed directly by the huge mounting frame and everything mounted on it. The accelerator will be pointed to various directions by physically moving the entire mounting frame—which will have a total mass on the order of $1.5\times10^{6}$ MT. The basic architectural design of the mounting system is illustrated in FIGS. 6 and 7.

Figure 6:
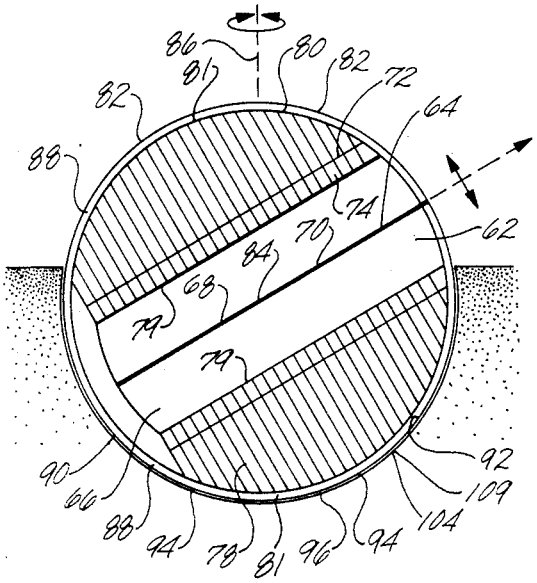
FIG. 6 is a schematic vertical cross section of the electromagnetic accelerator taken along the vertical longitudinal mid-plane of the launch tube mounted inside two concentric rotatable spheres.
Figure 7:
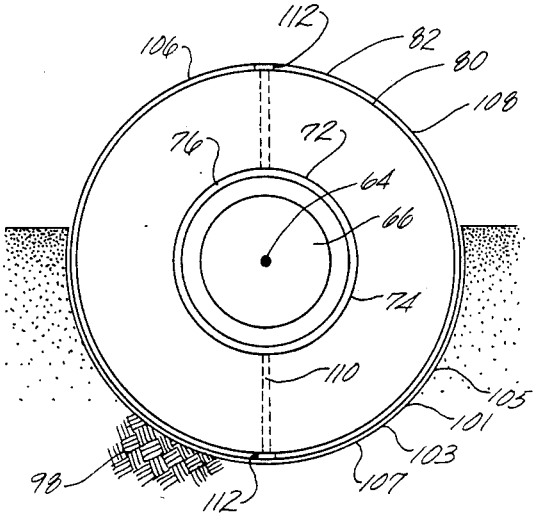
FIG. 7 is a schematic transverse cross section of the electromagnetic accelerator taken through the launch tube mounted inside two concentric rotatable spheres.

FIG. 6 is a schematic vertical cross section of the electromagnetic accelerator 62 taken along the vertical longitudinal mid-plane of the launch tube 64. The entire accelerator, including all of the high voltage storage capacitors 66, launch tube 64, drive coils 68, switching systems 70, power supplies 72 and various power conditioning systems 74 and control systems 76, are all rigidly mounted on a massive steel frame 78 via a mounting structure 79 that is completely enclosed within two movable concentric spheres 80,82 that can be rotated about two mutually perpendicular axes 84,86. The mounting frame 78 is rigidly mounted inside the inner sphere 80 via a mounting structure 81. FIG. 7 is a schematic transverse cross section taken through the accelerator tube 64 further illustrating the general design and construction of the complete electromagnetic launching system. Although the drive coils 68 are mounted around the launch tube 64, they are rigidly connected—and anchored—to the internal structural frame 78 so that the recoil forces exerted on the drive coil 68 by the passing dipole coils of the launch sabot are transmitted directly to the internal structure 78 and absorbed by its inertial mass and by the inertial mass of the two giant spheres 80,82 and all the systems mounted inside them. Consequently, in this design, the enormous accelerating forces will not generate any stress whatsoever on the actual launch tube 64. The accelerating forces will be absorbed directly by the huge internal structural frame 78 and absorbed by all of the inertial mass anchored to it (which is primarily represented by the huge high voltage capacitor banks 66).

The inner sphere 80, is 310 m (1,017 ft) in diameter and is also made of high-strength steel. Taking the skin thickness to be 6 cm (2.36 in), this sphere will have a total mass of about 140,000 MT. The entire internal structural frame 78 is rigidly anchored to the inside walls of this inner sphere 80.

The inner sphere 80 is mounted on heavy-duty steel wheels 88 that ride on a plurality of circular coaxial steels rails 90 with a horizontal axis 84 extending along its diameter that are rigidly attached to the inside walls 92 of the outer sphere 82. The diameter of this outer sphere 82 is 312 m (1,024 ft) and has a skin thickness of 6 cm (2.36 in). It is also constructed of high-strength steel and has a total mass of about 143,000 MT.

The outer sphere 82 is mounted on thousands of wide-track heavy duty steel wheels 94 that ride on a plurality of circular coaxial rails 96 embedded in bedrock 98 with a vertical axis 86 passing through its diameter. There are 100 of these circular wide-surface steel suspension rails 96 mounted in bedrock 98 which are designed to distribute the total weight of the entire system over a large area of the bedrock foundation. Approximately three-fifths of the outer sphere 82 is mounted below ground level in a huge hemispherical cavity 101 fitted with thick steel walls 103. These steel walls 103 are fitted with hundreds of steels wheels 105 that provide additional support for the outer sphere. These wheels 105 have axes tangent to the spherical walls 103 of the cavity 101 and therefore provide lateral support for the outer sphere 82 and for the entire system. The recoil force of the accelerator is therefore transmitted to and ultimately absorbed by the bedrock walls of the huge cavity 101.

Figure 8:
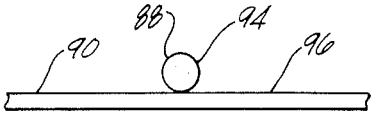
FIG. 8 is a schematic longitudinal cross section through a suspension wheel illustrating its design and construction.
Figure 9:
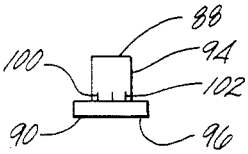
FIG. 9 is a transverse cross section of FIG. 8.

As is illustrated in the cross sections of FIGS. 8 and 9, all of the wheels 88,94 are made with a plurality of grooves 100 that fit snugly inside a like plurality of flanges 102 mounted on the rails 90,96 for maintaining proper alignment. The outer sphere 82 is rotated by a plurality of heavy duty electric motors 104 that are mounted in the bedrock foundation all around the sphere 82. These motors 104, drive gears 109 (FIG. 6)

with sprockets that fit into steel drive belts 107 mounted around the outside periphery of the outer sphere 82 extend in 360° circles coaxial with the vertical rotation axis. The inner sphere 80 is rotated around its horizontal axis by a similar electric drive system. In order to achieve high rotation rates on the order of 1°/sec within a short time interval, the total power of these electric driving motors will be about 50 MW.

Figure 10:
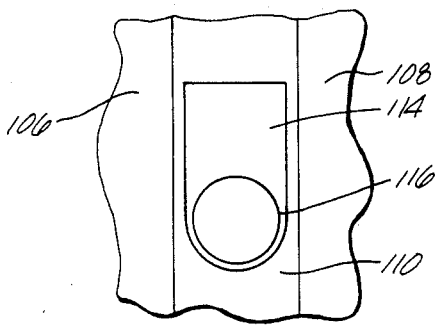
FIG. 10 is an enlarged schematic front view of the end of the launch tube mounted on a movable section between the two hemispheres of the outer sphere.

As shown in FIGS. 7 and 10, the outer sphere 82 is composed of two separate hemispheres 106,108 divided by a central, 1.5 m (4.92 ft) wide, band-like structure 110, that slides smoothly between the two hemispheres 106,108 by means of an interlocking groove/flange assembly. This sliding section 110 is rigidly connected to the inner sphere 80 via a stand-off beam structure 112. The circular section 110 is equipped with a 6 cm thick sliding steel door 114 that covers a circular hole 116 passing through the section 110. The end 118 of the launch tube 64 is rigidly connected to the periphery of this hole and provides a means for launching the sabot out of the two concentric spheres surrounding the accelerator.

When the inner sphere 80 is rotated about its horizontal axis 84, the band-like section 110 also rotates along with it by sliding between the two hemispheres 106,108 of the outer sphere 82. When the outer sphere 82 is rotated about its vertical axis 86, the inner sphere 80 is carried along with it and thus, the entire system also rotates about the vertical axis 86. Therefore, by simultaneously rotating the inner sphere 80 about its horizontal axis 84, and rotating the outer sphere 82 about its vertical axis 86, the launch tube 64 can be pointed to any position in the sky above a minimum elevation angle of 10° (up to, and including the 90° zenith position with an accuracy of 0.1 seconds of arc ($5\times10^{-7}$ rad)). The mounting is designed such that the center of both spheres (which coincide) always lies along the central longitudinal axis of the accelerator tube regardless of the direction it is pointing.

This hug movable double sphere mounting assembly is an important design feature of the electromagnetic launching system disclosed herein because it enables the 288 m long launch tube to be pointed in various directions (360° in azimuth and between 10° and 90° in elevation), and launch high mass sabots at hypervelocities without generating any recoil force on the launch tube itself. This recoil force (which was shown to be enormous) will be absorbed directly by the massive internal steel framework 78, everything mounted on it, the two massive steel spheres, and ultimately by the bedrock walls of the huge cavity 101. Thus, the recoil impulse will be hardly noticeable which will enable the launch tube to be pointed in the proper direction with extremely high accuracy.

Since the total mass of a typical sabot is 8,520 kg, a launch velocity of 8,000 m/sec corresponds to a launch energy of $2.71\times10^{11}$ Joules. Consequently, the total energy storage capacity of the primary discharge capacitor bank 66 will be sized to exceed this value by a wide margin. In order for the capacitor bank 66 to be as close to the drive coils 68 as possible, they will be designed as very thick walled annular cylinders with a hollow cylindrical central region occupied by the drive coils and the evacuated launch tube. Thus, the central longitudinal axis of the cylindrical capacitor bank is coincident with the central longitudinal axis of the launch tube. Since there are 120 separate drive coils (with mid-plane separations of 2.4 m) there are 120 separate primary energy storage discharge capacitors. The length of each separate cylindrical storage capacitor is 2.0 m and the inside and outside radii are 2.0 m and 40 m respectively. Thus, the total volume of each storage capacitor will be about 10,000 $m^3$. Assuming that the volume energy storage density of the capacitors is 350 $KJ/cm^3$ (which is state-of-the-art) each capacitor in the bank will have a storage capacity of $3.50\times10^9$ Joules. Therefore, the total energy storage capacity of the primary discharge capacitor bank will be $4.20\times10^{11}$ Joules. Since the mass energy storage density of the capacitors can be taken to be 0.3 KJ/kg, the total bulk mass of the capacitor bank will be about $1.40\times10^6$ MT.

A large amount of the remaining volume of the inner sphere not occupied by the primary capacitor bank 66 is used for various high voltage power conditioning systems 74 and power supplies 72. These power supplies 72 keep the capacitor bank 66 charged with the required electrical energy for pulsing the drive coils. The electric input power to this power supply system comes from a large inductive electric energy storage system embedded deep underground below the launcher. By using a plurality of superconducting power transmission lines, surges of electric power can be fed into the inner sphere from the underground energy storage system at levels exceeding 50 GW.

In order to allow all of the high voltage systems to be mounted close to each other without arcing due to atmospheric breakdown, a large portion of the inner sphere 80 that surrounds the accelerator and all of the related high voltage systems will be hermetically sealed, and the air inside it will be replaced with helium gas at ambient atmospheric pressure. This insulating dielectric gas environment will eliminate short circuits due to atmospheric breakdown. Thus, the various high voltage electrical systems of the accelerator can be mounted close together without short circuiting.

Figure 11:
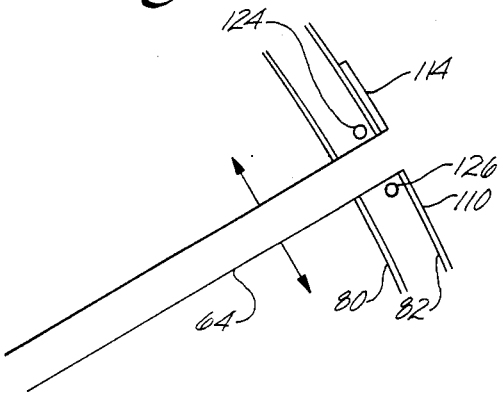
FIG. 11 is an enlarged schematic side view of the end of the launch tube mounted between the two concentric spheres with an automatic diaphragm dispensing system mounted on the end of the tube and a high-speed shutter mechanism mounted adjacent the diaphragm dispensing system.

As is shown in FIG. 11, the last 1.0 m (3.28 ft) of the launch tube 64 is located between the inner sphere 80, and the outer sphere 82. This one meter long end section is fitted with an automatic diaphragm dispensing system 153 and an ultra high speed shutter mechanism 151 for sealing the evacuated launch tube 64 immediately after a sabot is launched to preserve its vacuum.

Figure 12:
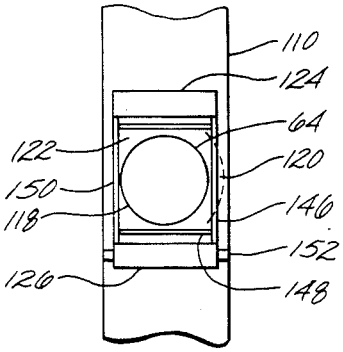
FIG. 12 is an enlarged schematic transverse cross section of the end of the launch tube illustrating the design and construction of the automatic diaphragm dispensing system.
Figure 13:
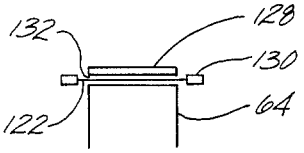
FIG. 13 is an enlarged schematic longitudinal cross section of the end of the launch tube further illustrating the design and construction of the automatic diaphragm dispensing system.
Figure 14:
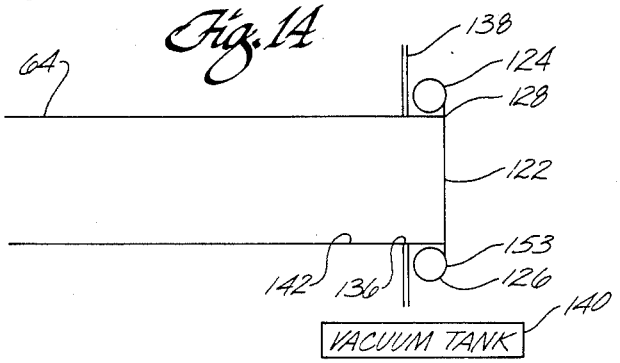
FIG. 14 is an enlarged schematic longitudinal cross section of the end of the launch tube further illustrating the design and operating principles of the diaphragm dispensing system and shutter mechanism.

The detailed operating principles of the diaphragm dispensing system are further illustrated schematically in FIGS. 12, 13 and 14. FIG. 12 is a transverse cross section through the end of the launch tube 64 illustrating a long sheet of serially connected diaphragms 122 rolled up on a roll 124. This roll 124 feeds the diaphragm 122 across the end of the launch tube 118 onto a take-up roll 126 mounted on the other side of the launch tube 64. FIG. 13 is a longitudinal cross section showing how the diaphragm 122 is passed over the end of the launch tube 64 and clamped securely to it by a small clamping ring 128. This ring 128 is mounted directly over the diaphragm sheet with a small 1 cm gap 132 that forms a narrow slot for the diaphragm 122 to move through. After each launch, the clamping ring 128 releases the diaphragm by moving upward by a small actuating system 130 to form the slot 132 thereby allowing a new 1.2 m by 1.2 m square section of diaphragm 122 to be advanced into position over the end 118 of the launch tube. As soon as this is accomplished, the clamping ring 128 is lowered thereby clamping the new diaphragm section over the end of the launch tube making an air-tight seal.

The diaphragm sheet is mounted between two parallel mounting ribbons 146 extending along the longitudinal edges, and partitioned into 1.2 m by 1.2 m square sections by transverse mounting ribbons 148 extending between the two longitudinal ribbons in a ladder-like pattern. The two outside ribbons 146 are equipped with small guide holes 150 similar to those on movie film for guiding and moving the sheet through the narrow slot 132. Thus, the diaphragm sections resemble the individual picture frames on a continuous strip of movie film that are moved, and momentarily stopped across the projection aperture of a movie projector.

When a new sabot is fired, it breaks through the diaphragm section. The clamping ring 128 is lifted, and the long roll of 1.2 m wide diaphragm 122 is advanced by about 1.4 m thereby positioning a new 1.2 m by 1.2 m section of diaphragm over the end of the launch tube. This entire cycle is automated and computer controlled with electrically driven servo motors 152. By using this diaphragm system, the sabot will not encounter any atmospheric gas until it actually penetrates through the diaphragm into the open atmosphere where the resulting shock waves can be kept away from the interior of the launch tube. The design of the system is such that the clamping ring 128 is directly under the sliding door 114 when the door is closed so that only this end section of the launch tube is uncovered when the sliding steel door 114 is opened. The diameter of the hole 116 is just large enough to house the ring system. All other parts of the accelerator always remains completely covered and shielded from the outside atmosphere.

Figure 15:
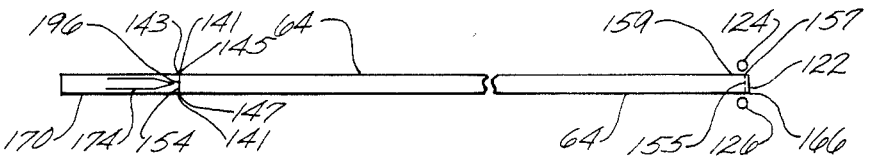
FIG. 15 is a schematic longitudinal cross section of the accelerating tube illustrating how a sabot is introduced into the evacuated launch tube by means of an evacuated sabot canister.

A sabot is introduced into the vacuum tube 64 and launched by first moving an evacuated cryogenic sabot storage canister 170 up to the accelerator tube (via a moving conveyor system) and clamping it to the tube entrance directly in front of an air-tight sliding door 154 (FIG. 15). The sabot is injected into the tube 64 by simultaneously opening the tube door 154, and a similar sliding air-tight door 196 mounted on the evacuated storage canister 170. A small injection system mounted inside the canister forces the sabot to move out of the canister and into the accelerator tube 64. When the sabot advances to a certain position near the first drive coil, this coil is pulsed and the acceleration process, described above, rapidly accelerates the sabot through the launch tube. At the instant the sabot is completely past the entrance door 154, the door 154 is immediately closed. The empty canister is unclamped from the tube entrance, moved away by the conveyor system and replaced with a new canister, which is clamped to the tube entrance exactly like the previous canister. During this sabot injection and reloading process, the tube entrance always remains sealed from the outside atmosphere. Since the sabot storage canisters are evacuated, no air can enter the launch tube from this end.

Another sliding air-tight door 155 is mounted on the end of the tube directly behind the diaphragm 122. This door 155 (which is part of the shutter mechanism 151) is always kept closed except for a short time period when a sabot is launched. Just before a sabot is launched, this door is opened but the air is still prevented from entering the vacuum tube by the diaphragm 122. By constructing this door 155 with strong, light-weight material such as Kevlar and designing its actuator 157 to be extremely fast, this door can be rapidly closed in a fraction of a second immediately after a sabot is launched thereby limiting the amount of air that can enter the tube after the sabot breaks through the diaphragm 122.

Figure 16:
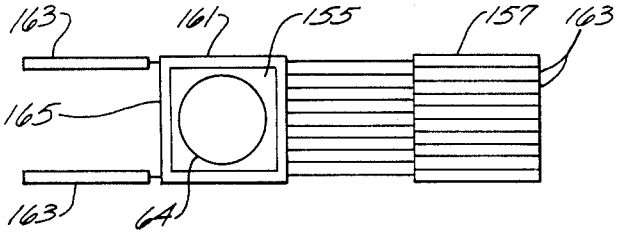
FIG. 16 is a schematic transverse cross section through the end of the launch tube further illustrating the design and construction of the fast acting sliding door actuating system of the shutter mechanism.
Figure 17:
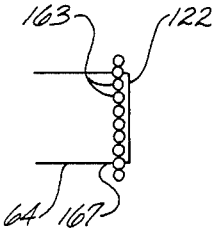
FIG. 17 is a longitudinal cross section of FIG. 16.

FIGS. 16 and 17 are schematic longitudinal and transverse cross sections illustrating the design and construction of an ultra fast acting door actuator system 157 for closing the air-tight sliding door 155 on the end of the tube immediately after a sabot is launched. As described above, this door 155 is made of Kevlar since this material has a very high strength-to-weight ratio. The door thickness will be assumed to be 1 cm (0.39 in) and will have a square geometry with dimensions 120 cm by 120 cm. Since the density of Kevlar is 1.4 gm/cm$^3$, the mass of the door will be about 20 kg. The door 155 slides back and forth across the tube entrance in two parallel channels 161 mounted on each side of the tube 64. The door 155 is catapulted closed by the force of 12 high power electromagnetic accelerator solenoides 163 connected to the edge of the door 155 and operating in tandem. These solenoids 163 operate similar to the discrete coil electromagnetic launcher but has ordinary electromagnet dipole coils instead of superconducting dipole coils. Each of these linear motor solenoids 163 generate an average force of 6,000N (1,349 lbs). Assuming that the moving members of the entire assembly (including the sliding door) has an inertial mass of 24 kg, the average acceleration of the closing door will be 3,000 m/sec$^2$ (306 gee). However, the accelerating solenoids 163 are designed to reverse the thrust direction when the leading edge 165 of the door reaches the half-way point such that the door 155 is automatically decelerated across the second half of the tube diameter and stopped after the leading edge 165 of the door reaches the other side of the tube. Thus, since the inside diameter of the tube is 1.02 m, it requires only 0.02 seconds for the leading edge of the door to reach the half-way point, and another 0.02 seconds for the door to be stopped on the other side of the tube. The entire process of closing the door therefore only takes 0.04 seconds. This design enables the door to be stopped without crashing into some wall and damaging the system. Hence, this ultra fast door actuator system is able to open and close the door any number of times without suffering any damage. Since there will be a partial vacuum created in front of the broken diaphragm at the instant a sabot passes completely through it, very little air will actually enter the tube during the 0.04 seconds it requires for the door 155 to be closed after a sabot is launched.

The electromagnetic solenoid actuators 163 are triggered to close the door 155 by a plurality of optical sensors 167 that determine the instant the end of a sabot is past the door 155. When this happens, electric current is instantly fed into the solenoids 163 which closes the door in 0.04 seconds. After the door 155 is closed, the diaphragm dispensing system 153 automatically slides a new section of diaphragm across the outside face of the sliding door 155 and made air-tight by the clamping ring 128. It only requires about 5 seconds for a new section of diaphragm to be positioned over the end of the launch tube and sealed air-tight by the clamping ring. About one or two seconds before the next sabot is launched, the door 155 is automatically opened by the solenoid actuators 163. The air is prevented from entering the tube after the door 155 is opened by the new diaphragm sealed over the end.

Figure 18:
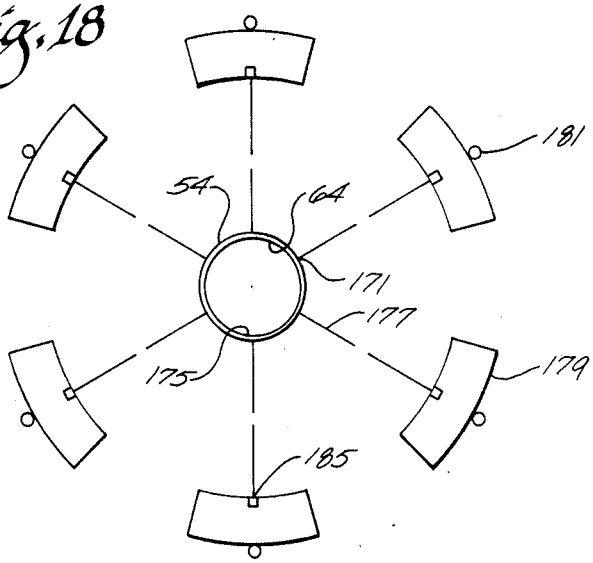
FIG. 18 is a schematic transverse cross section through the launch tube illustrating the design and construction of the high speed tube evacuation system.
Figure 18:
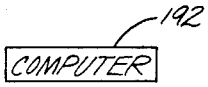

Since the launch tube has to have a very high vacuum environment of at least $10^{-4}$ Torr ($1.3\times10^{-7}$ Atm) when a sabot is accelerated through it, even the minute amount of air that manages to enter the tube before the door 155 can be completely closed must be removed before another sabot can be launched. The residual air will be removed by a large plurality of evacuation ports mounted through the tube wall and extending over its entire 288 m length. FIG. 18 is a transverse cross section through the launch tube 64 showing the design and construction of these tube evacuation ports 171. As is shown in FIG. 18, these vacuum ports 171 are mounted in six long rows 173 between the six aluminum guide sheets 54. Each port is 1.0 cm (0.39 in) wide and 10 cm (3.94 in) long and separated from the adjacent port in the row by 5 cm (1.97 in). Consequently, since these six rows extend for a distance of 288 m, all along the tube walls, the total cross sectional area of these ports is 11.52 $m^2$.

These exhaust ports 171 are connected to a plurality of high vacuum conduits 175 that extend 360° around the tube and along its entire length. These conduits 175 are connected to another plurality of vacuum conduits 177 that radiate outward from the tube 64 between the discharge capacitors to a system of 6 very large thermally insulated cryogenically pumped vacuum tanks 179. Each of these cryogenic vacuum storage tanks 179 has a volume capacity of 1,000 $m^3$ and are mounted along the inside walls of the inner sphere. In order to provide a high degree of redundancy in the design of this evacuation system, all of these vacuum storage tanks 179 operate independent of each other, but each one is capable of evacuating the entire tube to the required $10^{-4}$ Torr operating pressure. These vacuum storage tanks 179 are initially evacuated down to a pressure of about $10^{-2}$ Torr by a plurality of conventional high power mechanical pumps 181. After this pressure is reached, a cryogenic pumping system 185 reduces the pressure to about $10^{-7}$ Torr. This cryogenic pumping system operates continuously and comprises a vast area of condensing surfaces inside the tanks 179 where molecules of gas condense to solid particles thereby achieving the extremely high vacuum. (See the article "Cryopumping," *Cryogenics*, Vol. 5, No. 2, April 1965, pp. 57–67 by J. P. Dawson and J. D. Haygood). Since six of these large volume vacuum tanks 179 operate in parallel continuously, it only requires about 15 seconds to restore the tube to the required $10^{-4}$ Torr vacuum after each launching.

Figure 19:
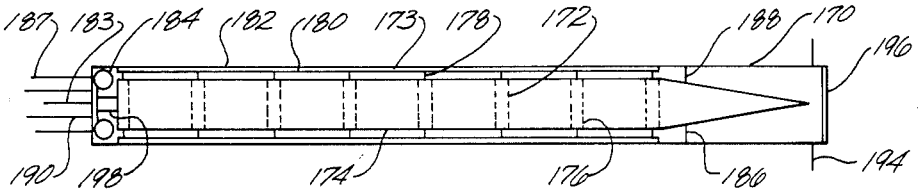
FIG. 19 is a schematic longitudinal cross section of a sabot storage canister.
Figure 20:
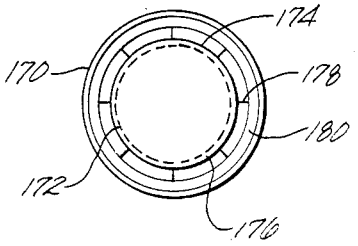
FIG. 20 is a schematic transverse cross section of a sabot storage canister.

FIGS. 19 and 20 are schematic longitudinal and transverse cross sections illustrating the design and construction of an evacuated cryogenic sabot storage canister 170. The sabot storage canister 170 is primarily designed to maintain the superconducting dipole coils 172 mounted on the sabot 174 at cryogenic temperatures since no cryogenic cooling systems are mounted on the sabot itself. This is accomplished by circulating liquid helium through small liquid helium reservoirs 176 mounted around portions of the dipole coils 172. The liquid helium is injected into and withdrawn from the coils via a plurality of detachable cryogenic feed conduits 178 communicating with a relatively large reservoir of liquid helium stored inside a thermally insulated vessel 180 mounted inside the canister 170. A relatively thick jacket 182 of cryogenic thermal insulating material is mounted around the inside walls of the canister to restrict the flow of ambient heat from entering the canister 170. The interior of the canister is also evacuated and maintained at a pressure of $10^{-4}$ Torr via a vacuum conduit 183.

The canister is also equipped with an internal power supply 184 that is connected to the sabot via detachable electric cables 186. Power can also be supplied to the sabot from an external power cable 187 that is connected to the storage canister. A plurality of internal detachable electronic command and control cables 188 are connected to the sabot. These cables 188 are attached to external cables 190 that provide direct data links with a central control computer 192. This computer 192 generates the targeting coordinates for the guided warheads mounted inside the sabot 174 (which can be changed 10 seconds before launch). All of the electrical and cryogenic fluid connecting cables and conduits are designed to automatically disconnect from the sabot 174 as soon as the sabot is injected into the launch tube 64. The sabot 174 is mounted inside the canister 170 on a structure 173.

The sabot is injected into the launch tube 64 by first moving the sabot canister 170 sideways by means of an automatic conveyor system 194 and stopping it such that the longitudinal central axis of the sabot canister is aligned with the longitudinal central axis of the launch tube (FIG. 15). After this is accomplished, the canister is moved forward a short distance until the external face of a sliding door 196 mounted on the canister comes into direct contact with the external face of the launch tube door 154. After this is accomplished, the abutting faces are clamped together via clamps 141 forming an airtight seal 143 around the adjacent tube door 154 and canister door 196. Both of these doors are then opened simultaneously via actuators 145,147 and the sabot is injected into the tube by a hermetically sealed, high pressure gas driven telescoping piston actuator 198 mounted inside the sabot canister directly behind the sabot 174.

Figure 21:
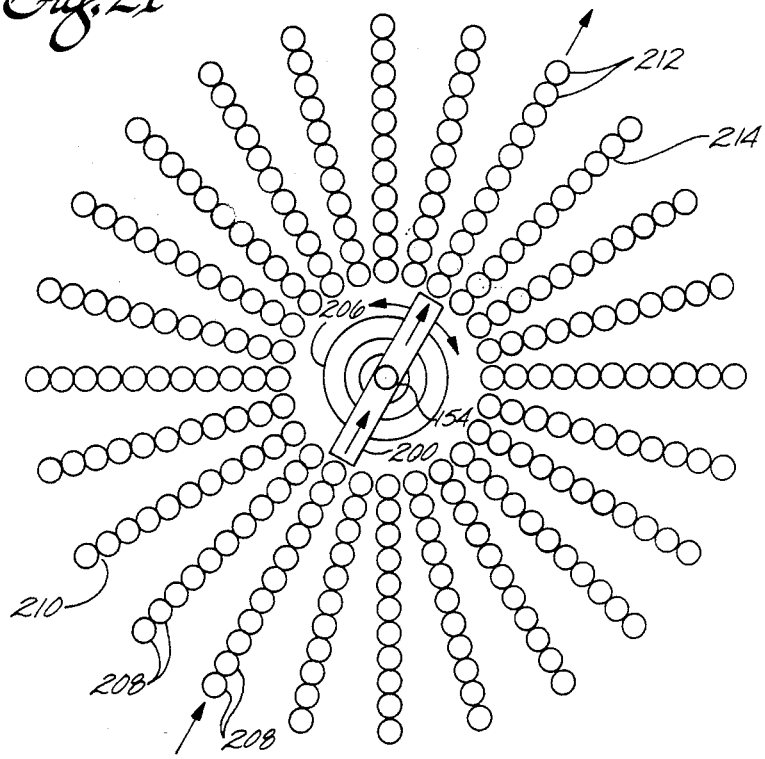
FIG. 21 is a schematic transverse cross section at the entrance of the accelerator illustrating the design and construction of a multiple conveyor, automatic canister selection and loading system.
Figure 22:
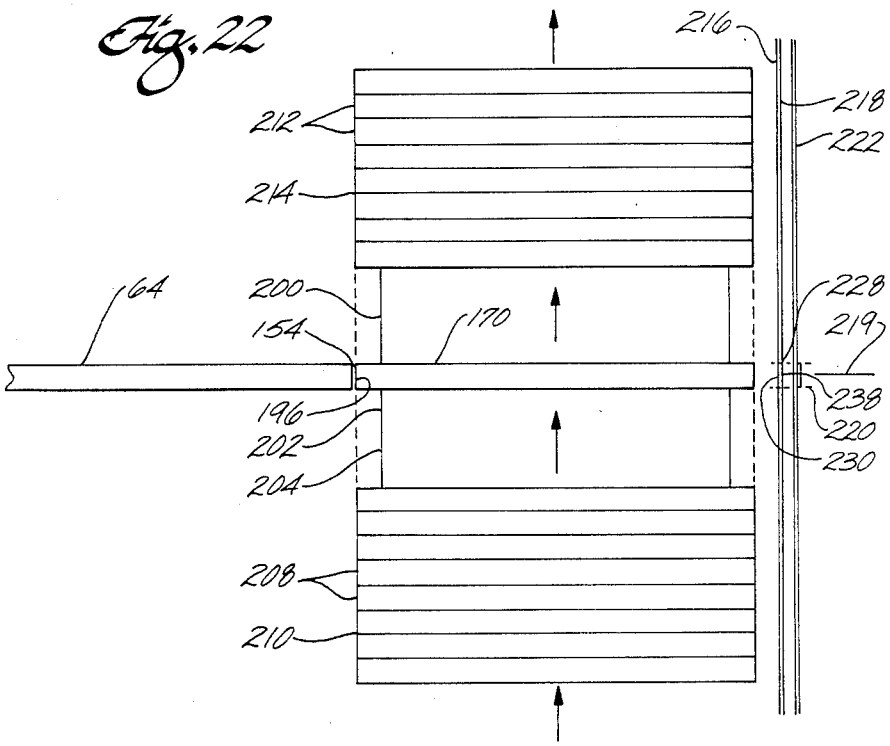
FIG. 22 is a schematic longitudinal cross section of the multiple conveyor, automatic canister selection and loading system.

FIGS. 21 and 22 are schematic transverse and longitudinal cross sections further illustrating the design and construction of the high speed automatic loading system. This system comprises a central canister selector and loading conveyor 200 that can be rotated 360° around the loading door 154 of the launch tube 64. This conveyor 200 has a width of 20 m (65.6 ft) and a length of 9 m (29.5 ft) and pivots around the entrance door 154 of the launch tube which is positioned at the center of the forward edge 202 of the conveyor 200. The conveyor 200 is mounted on wheels 204 that ride on a plurality of circular coaxial tracks 206 mounted on each side of the conveyor 200. These tracks 206 have a central axis coincident with the central longitudinal axis of the launch tube 64.

The loaded sabot canisters 208 are automatically brought up to the loading conveyor 200 by 12 separate feeding conveyors 210. The empty canisters 212 are carried away by 12 corresponding discharge conveyors 214 that are mounted diametrically across from the feeding conveyors 210 with the central axis of the launch tube passing through the center. All of the various conveyors have widths of 20 m and move the canisters sideways. The feeding and discharge conveyors are symmetrically mounted around the central axis in a star-like pattern and extend outward a distance of 150 m in all directions. These feeding conveyors 210 and discharge conveyors 214 are mounted on the internal steel frame 78 and follow curving arcs that remain close to, and equidistant from the inside walls 216 of the inner sphere 218 and such that the longitudinal axes of the canisters remain normal to the inside walls 216 of the inner sphere. (This design avoids sharp bends in the conveyor paths.) The capacity of each feeding and discharge conveyor is 100 canisters. Thus, since there are 12 feeding conveyors 210, the inner sphere can be loaded with a total of 1,200 sabots ready for launching. All of the feeding conveyors 210 are mounted below the central mid-plane 219 of the inner sphere such that all loaded canisters are always below ground level for extra protection. The corresponding discharge conveyors 214 carrying empty canisters are mounted above the central mid-plane 219.

Each particular feeding conveyor 210 carries its own special type of munitions. For example, the first conveyor can be loaded with sabots containing 2 independently targetable 10 MT hydrogen bomb warheads. The second conveyor can be loaded with sabots containing 48 independently targetable 100 KT nuclear warheads. The third could be loaded with sabots containing 3 nuclear pumped x-ray lasers. The fourth could be loaded with sabots containing 6 very high altitude self-propelled self-guided ASAT missiles (for geosynchronous orbits or beyond). The fifth feed conveyor could be loaded with sabots containing 12 low or intermediate altitude ASAT missiles. The sixth could be loaded with sabots containing strategic reconnaissance satellites that can be launched into various orbits as replacement satellites in the event critical previously deployed satellites are destroyed by enemy action. The seventh could be loaded with sabots containing 48 independently targetable neutron warheads. The eighth could be loaded with sabots containing ten million, one-gram steel kinetic energy pellets for close-in self defense. The ninth could be loaded with sabots containing 12 self-guided 500 KT high altitude EMP nuclear warheads. The tenth could be loaded with sabots containing 100 self-guided non-nuclear anti-tank munitions. The eleventh could contain 48 independently targetable, 100 kg high explosive warheads; and the twelfth could contain sabots loaded with 6 self-guided, water penetrating high explosive anti-submarine homing torpedoes.

Any one of these various weapon systems can be automatically loaded into the electromagnetic launcher by simply rotating the canister selector/loading conveyor 200 until it is opposite the desired feeding conveyor 210. This feeding conveyor 210 is then moved one canister diameter (which is a distance of about 1.5 m) and automatically transfers one canister loaded with the desired munitions onto the moving loading conveyor 200. The loading conveyor 200 then transports the canister 4.5 m to a precise point directly behind the launch tube 64. The canister is then moved forward a short distance (e.g., 1 cm) and clamped to the launch tube. The air-tight doors 154,196 are opened and the sabot is launched. As soon as the doors 154,196 are closed, the empty canister is unclamped from the launch tube and the loading conveyor 200 automatically moves it 4.5 m to the discharge conveyor 214, which accepts the empty canister by moving 1.5 m. The entire process can be completed in about 30 seconds.

Some sabots mounted inside the storage canisters can be relatively short with only two or three superconducting dipole coils. The payload in these small sabots could be a single self-guided warhead with a relatively low mass. The design of the storage canisters is such that sabots of various lengths can be mounted inside them.

With such a wide variety of munitions available which can be "cued up" and launched at any time within a matter of seconds, this single launcher could be used in many different battles taking place simultaneously anywhere on Earth—and win every one because of the virtually unlimited number of warheads that can be delivered with almost perfect accuracy.

If a train of identical sabots are to be launched, this loading and launching process is much simpler because the loading conveyor 200 does not have to be rotated after each launching. After the loading conveyor 200 is rotated to the desired feeding conveyor 210, the feeding conveyor 210 is initially moved a distance of three canister diameters (4.5 m) which automatically places three loaded canisters on the loading conveyor 200 with the first positioned directly in front of the launch tube with two other loaded canisters next to it. As soon as the first canister is launched, the loading conveyor 200 and feeding conveyor 210 are both moved simultaneously a distance of one canister diameter. This action automatically moves the empty canister toward the discharge conveyor 214 a distance of one canister diameter, while simultaneously placing the second loaded canister in front of the launch tube, and while a fourth canister is simultaneously placed in line on the loading conveyor 200 right next to the third canister. This process becomes a train of loaded canisters moving intermittently sideways from the feeding conveyor toward the launch tube, and a train of empty canisters moving intermittently away from the launch tube and onto the discharge conveyor. The action is essentially identical to that of firing an ammunition belt of bullets through a conventional machine gun. If the tube evacuation system were fast enough, the rate of fire in this situation could be as high as 10 launches per minute. Consequently, when operating in this very fast repetition mode, this single launcher could simulate the effects of an entire fleet of strategic bombers (or ICBMs) delivering a rain of nuclear warheads on any target, or group of targets, located anywhere on Earth. By carefully designing the launch trajectories, it will be possible to launch thousands of independently targetable nuclear warheads such that they all reach their assigned targets (which could be widely separated) and simultaneously detonate at the same predetermined instant with a maximum expected timing error of less than 2 seconds. Although such a feat may appear to be technically impossible, it is definitely not technically impossible. In fact, it could be easily accomplished with this electromagnetic launcher.

Figure 23:
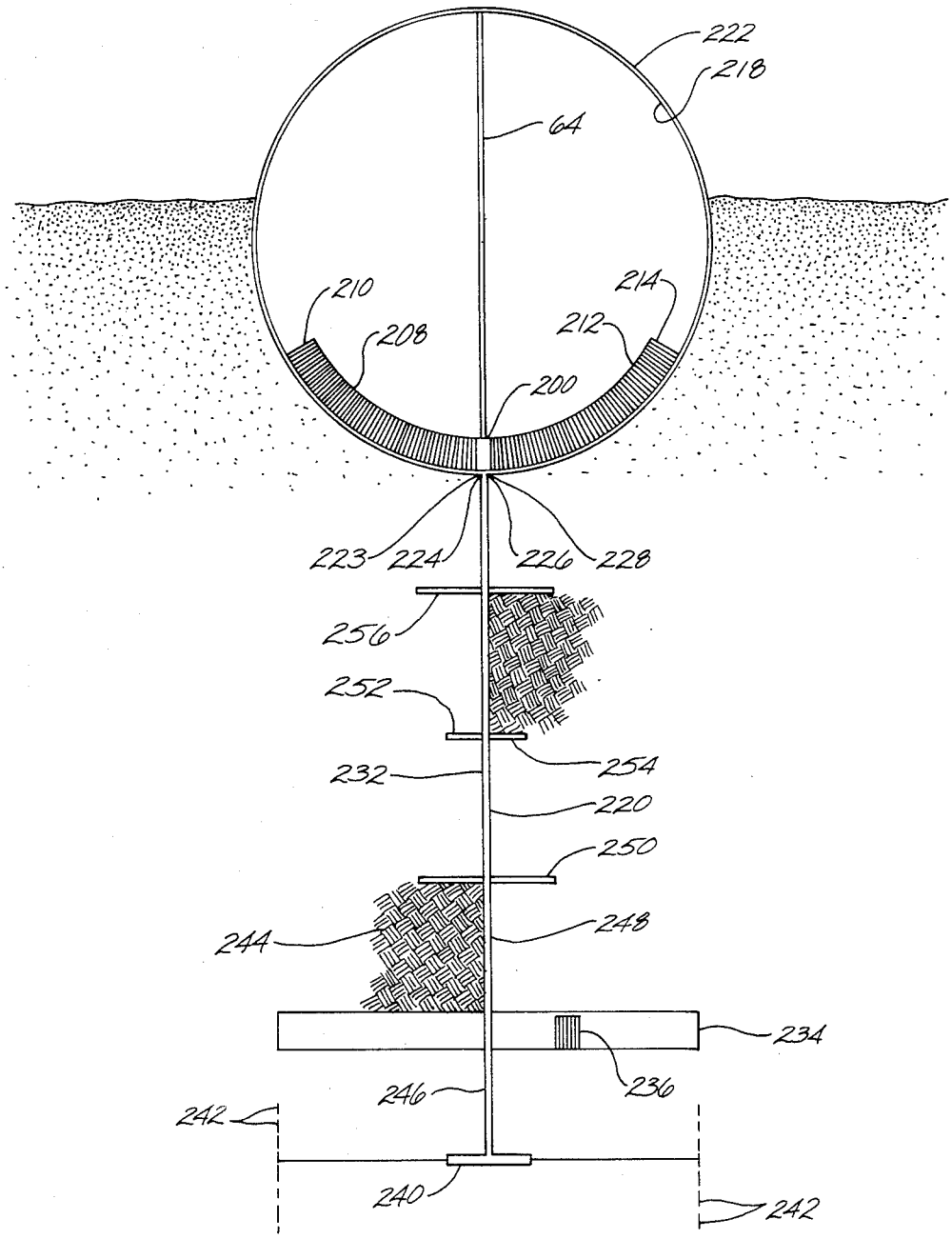
FIG. 23 is a vertical cross section through the central shaft directly below the electromagnetic launcher illustrating the design and construction of the underground bunkers.

When any particular row of loaded sabot canisters on a feeding conveyor is exhausted, a new supply can be brought up into the sphere by a vertical conveyor from a deep underground storage bunker. FIG. 23 is a schematic vertical cross section through the center of the spheres illustrating the design, construction and operating principles of this underground resupply system. A circular 3 m (9.8 ft) diameter vertical shaft 220 is excavated directly under the outer sphere 222 with a vertical central axis coincident with the vertical rotation axis of the outer sphere 222. This shaft 220 is connected to a 3 m diameter circular passageway 224 cut into the bottom of the outer sphere 222 centered around the vertical rotation axis 86 by means of a rotating collar joint 226. The mounting is such that the outer sphere 222 can be rotated around the circular passageway 224, and the vertical shaft 220 connected to it. This passageway can be opened and closed by a sliding door 223 mounted on the outer sphere over the collar joint 226.

A 3 m diameter circular passageway 228 is also cut through the inner sphere 218 around an axis coincident with the central longitudinal axis of the launch tube 64 directly behind the center of the loading conveyor 200

(see FIG. 22). This passageway 228 can be opened and closed by another sliding door 230. When a new supply of loaded sabot canisters is required, the inner sphere 218 is rotated inside the outer sphere 222 about its horizontal axis until the launch tube 64 is pointing vertically upward in the 90° position such that its longitudinal axis is aligned with the vertical rotation axis of the outer sphere 222. The sliding doors 223 and 230 are then opened thereby providing a passageway through both spheres and directly into the vertical shaft 220.

A vertical conveyor 232 is mounted inside the shaft 220 which extends downward 600 m (1,969 ft) to a large storage bunker 234 containing thousands of loaded sabot canisters 236 with all types of munition payloads. The desired loaded canisters are placed on the vertical conveyor 232, one after another, and lifted to the inner sphere 218 as a long continuous train. The loading conveyor 200 is utilized to place the loaded canisters onto the corresponding feed conveyor 210. This is accomplished by first rotating the loading conveyor 200 so that the discharge end is opposite the empty feed conveyor 210. A relatively small transfer system 238, mounted on the inner sphere 218, transfers each loaded canister from the end of the vertical conveyor 232, to the center of the loading conveyor 200. The loading conveyor 200 then moves the loaded canisters continuously onto the feed conveyor 210. The entire process is automated and takes place continuously so that a complete new supply of 100 loaded sabot canisters can be stored back on the feed conveyor 210 in about two hours.

The 100 empty canisters that are stored on the diametrically opposite discharge conveyor 214 are returned to the storage bunker 234 in a reverse process. When these canisters are returned to the storage bunker, they are refurbished and loaded with new launching sabots. Thus, they are continuously recycled.

As is shown in FIG. 23, there are several large subterranean chambers excavated along the vertical shaft 232. The deepest chamber 240 contains a control room for a large superconducting energy storage system. This energy storage system comprises ten separate and independently operating superconducting solenoids 242 that are embedded in the surrounding bedrock 244. Each of these units 242 has an inductive energy storage capacity of $10^{13}$ Joules (2,778 MWh) and are similar to those designed by R. W. Boom. (See his paper, "Superconductive Energy Storage For Diurnal Use By Electric Utilities," *IEEE Transactions On Magnetics*, Vol. MAG-17, No. 1, Jan. 1981, pp. 340–343.) Thus, the total energy storage capacity of this system is $10^{14}$ Joules (27,778 MWh). Assuming that the electromagnetic launcher has an electric-to-kinetic operating efficiency of 95%, this amount of stored electrical energy is sufficient to launch 1,000 sabots having a mass of 3,000 kg on long-range ballistic trajectories with a launch velocity of 8,000 m/sec. Thus, for all practical purposes, this energy storage system enables the launcher to be completely self-sufficient in terms of required electrical energy. It should also be emphasized that this inductive energy storage system is well within the state-of-the-art. The electric power is fed to the electromagnetic accelerator by a plurality of superconducting power cables 246 extending along the vertical shaft 220.

The purpose for constructing ten individual units instead of one large unit is to avoid the possibility of losing all the stored energy because of a component failure. Hence, in this design, if a failure does occur, the stored energy in the malfunctioning unit can be temporarily withdrawn and fed into the other 9 units. After the malfunction is repaired, the energy can be returned. Thus, essentially no energy is lost even when a malfunction occurs (provided there is sufficent warning time to make the transfer). This safety system is automatically controlled by monitoring systems and computer controlled fast-acting switching circuits.

The electrical energy used to charge up the superconducting storage solenoids 242 is generated outside the electromagnetic launch complex. For example, it may be generated in a near-by hydroelectric generating plant. The electrical energy is transmitted to the launch complex by underground high voltage DC power transmission lines. The power is fed down the vertical shaft 220 to the storage solenoids 242 by another plurality of superconducting power transmission cables 248.

The power control room 240 is located at a depth of 700 m (2,297 ft) below ground level. The vertical conveyor 232 extends all the way down to this level and serves as an elevator for personnel and for heavy equipment. As described above, the canister storage bunker 234 is located 600 m (1,969 ft) below ground level and represents the second deepest underground chamber. This bunker 234 is also equipped with elaborate repair facilities, work rooms, canister and sabot assembly rooms, nuclear warhead magazines, conventional high explosive warhead magazines, various stocks of guided missiles and all of the related support systems and facilities, including large electronic and cryogenic laboratories.

The third deepest chamber 250 is a large food depository stocked with various foods and large storage tanks for drinking water. Various life support systems such as air purification systems are also located on this level. This level has a depth of 500 m (1,640 ft).

The central control room 252 is located above the food storage depository and has a depth of 400 m (1,312 ft). This room is equipped with at least two very large supercomputers 254 for processing very high rates of incoming data. This incoming data stream will have many hundreds of sources. Some of these will be the North American Aerospace Defense Command Center in Cheyenne Mountain; early warning radars; orbiting satellites; and various command and control centers such as Washington, D.C. and airborne "Looking Glass" aircraft.

In the event of all-out nuclear war, these supercomputers 254 will process all of the incoming data in real time, combine it with targeting data previously stored, and generate an attack plan designed to effectively destroy as much of the enemy's nuclear strikeforce as possible in the shortest possible time. In particular, the supercomputers will instantly compute targeting coordinates, flight trajectories and launch times for the various sabot canisters. All of this information is fed into and coordinated by a central operations computer COC. All of the loaded canisters 208 on the various feeding conveyors 210 are electronically connected to the COC and receive targeting and trajectory data that is fed into and stored in the guidance system of each individual warhead. The canister selector and loading conveyor 200 is also controlled by the COC which generates the launch sequence and canister selection code.

The electric traction servo motors 104, which rotate the spheres about their rotation axes, are directed by the COC to point the accelerator in a certain direction for each launch. The power conditioning and power control systems of the electromagnetic accelerator receive commands from the COC to launch each particular sabot at a precise instant with a precise launch velocity u. Almost all mechanical and electrical operations taking place in the launch complex during this firing period is controlled by the COC system. All of the computers in the central control room would be backed up by many duplicates operating in parallel that could take over in case of any computer malfunction.

In view of the ultra fast response time of this weapon system, it would be possible to launch hundreds of independently targetable nuclear warheads to destroy enemy targets before any SAC bomber could leave its runway, or before any ICBM could leave its silo. Thus, the traditional nuclear strike force in the U.S. Strategic Triad would have to coordinate their attack plans with the electromagnetic launching system to avoid wasting these traditional strategic weapon systems on hitting targets already destroyed by the electromagnetic launcher.

Since the total number of crew members in the electromagnetic launcher complex will be about 150, a fairly large bunker 256 is provided for living quarters. This bunker 256 has a depth of 300 m (984 ft) and is centrally positioned around the vertical shaft 220. The design of these living quarters 256 would include spaceous sleeping rooms, recreation rooms, a library, private study rooms, a dining room, gymnasium, a theatre, and other facilities to maximize personal comfort. There would be enough food and life support systems to allow the crew to live comfortably for extended time periods without coming out of the complex. As shown in FIG. 23, the living quarters are located at the upper most level of the underground bunker complex.

Although the two thick-walled steel spheres that surround the electromagnetic accelerator would probably be able to survive a close nuclear detonation, a large array of defensive weapon systems would be deployed around its perimeter. These would include high acceleration ABMs, railguns, high velocity gas guns, nuclear ABMs, SAMs, conventional anti-aircraft weapons, ultra high power lasers, and other directed energy weapons. In addition to all of these defensive weapon systems, the launcher itself will be able to catapult millions of hypervelocity steel pellets like a giant shotgun at any object that approaches within a certain distance. Specially designed sabots, filled with 5,000 kg of steel pellets, will always be available on one of the feeding conveyors for providing the ultimate close-in point defense, and these giant shotgun cartridges could be fired every 20 seconds.

In order to provide the reader with quantitative information describing the actual operation of the electromagnetic accelerator launching munitions to targets at various ranges, a detailed numerical determination of the ballistic trajectories was performed. Table 1 gives the minimum required launch velocities $u_o$ of projectiles fired on ballistic trajectories at targets located at various distances D from the launcher. The corresponding specific launch energy $\hat{E}_o$ ($\frac{1}{2}$ $u_o^2$) and elevation angle $\phi_o$ of the launcher are also given. The apogee altitudes $H_o$ and the total flight times $T_o$ are given. The maximum voltage $V_m$ that must be generated by the launcher corresponding to the above design specifications is also given. For simplicity, a spherical Earth is assumed in the calculations and the effects of the Earth's rotation and atmospheric drag are not considered.

Since the drag coefficient of the launch sabot is 0.03 with a length-to-diameter aspect ratio of about 19:1, and since the mass of the sabot is several thousand kilograms, the effects of atmospheric drag will be negligible. The flight path of a projectile launched on a minimum energy ballistic trajectory 258 to a target 260 located 10,000 km (6,214 miles) from the launcher 262 is illustrated in FIG. 24. In an actual launch, the projectile is a sabot containing multiple independently targetable warheads that separate from the sabot before apogee and follow their programmed trajectories to their respective targets. However, these multiple post-apogee trajectories will be fairly close to that of a single projectile and are not shown in FIG. 24.

TABLE 1

Performance Characteristics Of An Earth-Based Electromagnetic Accelerator Launching Projectiles On Minimum Energy Ballistic Trajectories

| D (Km) | $u_o$ (Km/sec) | $\hat{E}_o$ (MJ/kg) | $V_m$ (kV) | $\phi_o$ (deg) | $H_o$ (km) | $T_o$ (min) |
|---|---|---|---|---|---|---|
| 1,000 | 3.013 | 4.54 | 262.88 | 42.75 | 239.95 | 7.91 |
| 2,000 | 4.109 | 8.44 | 358.50 | 40.51 | 458.84 | 11.71 |
| 3,000 | 4.860 | 11.81 | 424.02 | 38.26 | 655.32 | 14.93 |
| 4,000 | 5.428 | 14.73 | 473.58 | 36.02 | 828.19 | 17.88 |
| 5,000 | 5.878 | 17.28 | 512.84 | 33.77 | 976.38 | 20.63 |
| 6,000 | 6.243 | 19.49 | 544.69 | 31.53 | 1,098.99 | 23.23 |
| 7,000 | 6.546 | 21.43 | 571.12 | 29.28 | 1,195.26 | 25.70 |
| 8,000 | 6.799 | 23.11 | 593.20 | 27.03 | 1,264.60 | 28.02 |
| 9,000 | 7.012 | 24.58 | 611.78 | 24.79 | 1,306.58 | 30.19 |
| 10,000 | 7.192 | 25.86 | 627.49 | 22.54 | 1,320.96 | 32.22 |
| 11,000 | 7.345 | 26.97 | 640.83 | 20.30 | 1,307.62 | 34.07 |
| 12,000 | 7.474 | 27.93 | 652.09 | 18.05 | 1,266.67 | 35.76 |
| 13,000 | 7.582 | 28.74 | 661.51 | 15.80 | 1,198.36 | 37.26 |
| 14,000 | 7.672 | 29.43 | 669.36 | 13.56 | 1,103.09 | 38.57 |
| 15,000 | 7.746 | 30.00 | 675.82 | 11.31 | 981.46 | 39.69 |
| 16,000 | 7.804 | 30.45 | 680.88 | 9.07 | 834.21 | 40.61 |
| 17,000 | 7.849 | 30.80 | 684.81 | 6.82 | 662.25 | 41.32 |
| 18,000 | 7.880 | 31.05 | 687.51 | 4.58 | 466.64 | 41.83 |
| 19,000 | 7.899 | 31.20 | 689.17 | 2.33 | 248.57 | 42.14 |
| 20,000 | 7.905 | 31.25 | 689.72 | .08 | 9.38 | 42.24 |
| 20,038 | 7.905 | 31.25 | 689.73 | 0 | 0 | 42.24 |

It is apparent from this table that the launch angle $\phi_o$ gets smaller as the range increases. This illustrates the fact that minimum energy trajectories get flatter as the range D increases, and becomes circular at maximum range (20,038 km) which is equal to half the Earth's circumference. Neglecting atmospheric drag and the effects of the Earth's rotation, and assuming that the launcher is located at the top of a high mountain, a projectile launched on a minimum energy trajectory at maximum range will attain orbital velocity, circle the Earth in a circular orbit and return to the launcher after one complete revolution. (This possibility was first described by Newton in his "Principia" but up until now the construction of a sufficiently powerful launcher was impossible.)

Since the launch angles $\phi_o$ drop below the minimum 10° design capability of the launcher for sabots launched on minimum energy trajectories at targets with ranges greater than 15,584 km (9,683 miles), it will be necessary to launch the sabots on non-minimum energy trajectories beyond this range. FIG. 25 illustrates a non-minimum energy trajectory 264 designed for hitting targets 266 located on the Earth's surface 268 with the greatest possible distance from the launcher 270—20,038 km (12,451 miles).

It should be pointed out and emphasized that for any two points located on the Earth's surface that are not anti-polar, there exists only one unique minimum energy ballistic trajectory that can pass between them. These minimum energy trajectories are characterized by having the lowest possible launch velocity $u_o$, the lowest possible launch angle $\phi_o$, the lowest possible apogee altitude $H_o$, and the shortest possible flight time $T_o$. However, there exists an infinite number of non-minimum energy ballistic trajectories that can pass between any two points on the Earth's surface. For comparison, Table 2 gives a representative sample of non-minimum energy ballistic trajectories to the same targets assumed in Table 1.

TABLE 2

Representative Samples Of Non-Minimum Energy Ballistic Trajectories Of An Electromagnetic Accelerator Launching Projectiles To The Same Targets in Table 1

| D (Km) | u (Km/sec) | Ê (MJ/kg) | $V_m$ (kV) | $\phi$ (deg) | H (km) | T (min) |
|---|---|---|---|---|---|---|
| 1,000 | 3.369 | 5.68 | 293.94 | 61.94 | 506.42 | 11.65 |
| 2,000 | 4.359 | 9.50 | 380.31 | 55.22 | 813.43 | 15.74 |
| 3,000 | 5.060 | 12.80 | 441.47 | 50.90 | 1,084.77 | 19.33 |
| 4,000 | 5.598 | 15.67 | 488.41 | 47.42 | 1,325.35 | 22.67 |
| 5,000 | 6.027 | 18.16 | 525.84 | 44.36 | 1,536.27 | 25.82 |
| 6,000 | 6.377 | 20.33 | 556.38 | 41.52 | 1,717.52 | 28.82 |
| 7,000 | 6.668 | 22.23 | 581.77 | 38.84 | 1,868.77 | 31.68 |
| 8,000 | 6.911 | 23.88 | 602.97 | 36.25 | 1,989.56 | 34.39 |
| 9,000 | 7.117 | 25.33 | 620.94 | 33.74 | 2,079.48 | 36.94 |
| 10,000 | 7.291 | 26.58 | 636.12 | 31.27 | 2,138.21 | 39.31 |
| 11,000 | 7.439 | 27.67 | 649.04 | 28.85 | 2,165.54 | 41.50 |
| 12,000 | 7.564 | 28.61 | 659.94 | 26.47 | 2,161.46 | 43.50 |
| 13,000 | 7.669 | 29.41 | 669.10 | 24.10 | 2,126.06 | 45.28 |
| 14,000 | 7.756 | 30.08 | 676.69 | 21.76 | 2,059.64 | 46.85 |
| 15,000 | 7.827 | 30.63 | 682.89 | 19.44 | 1,962.78 | 48.18 |
| 16,000 | 7.884 | 31.08 | 687.86 | 17.14 | 1,835.80 | 49.28 |
| 17,000 | 7.927 | 31.42 | 691.61 | 14.85 | 1,679.82 | 50.14 |
| 18,000 | 7.958 | 31.66 | 694.32 | 12.57 | 1,495.72 | 50.75 |
| 19,000 | 8.013 | 32.10 | 699.12 | 12.02 | 1,558.02 | 53.57 |
| 20,000 | 8.056 | 32.45 | 702.87 | 11.18 | 1,565.40 | 55.92 |
| 20,038 | 8.056 | 32.45 | 702.88 | 11.10 | 1,556.02 | 55.92 |

The difference in flight time between Tables 1 and 2 illustrates how it is possible to design the launch trajectories such that many different sabots can be launched with multiple independently targetable nuclear warheads at different launch times such that all of the warheads reach their respective targets at the same time, and simultaneously detonate at the same instant. For example, consider the single target located at a distance of 10,000 km. As shown in Tables 1 and 2, the difference in flight time is 7.09 minutes. Consequently, if the launcher could launch sabots at a rate of 3 sabots per minute, it will be possible to launch 21 different sabots of multiple warheads at the target such that they all arrive and detonate simultaneously at the same instant. The first sabot would be launched on the non-minimum energy trajectory of Table 2 with a launch velocity of 7.291 km/sec and an elevation angle of 31.27° and its flight time would be 39.31 minutes. The last sabot could be launched 7.09 minutes later on the minimum energy trajectory given in Table 1 with a launch velocity of 7.192 km/sec, an elevation angle of 22.54° and a flight time of 32.22 minutes. Although all of the sabots would be launched at different times over a time period of 7.09 minutes, all of the warheads would reach the target simultaneously and detonate at the same instant. Thus, the simultaneous destruction of a thousand different targets can be easily and routinely achieved by simply launching a large group of sabots at precisly precalculated launch times separated by short time intervals and slowly changing the launch velocities u, and the launch azimuth $\theta$, and elevation angle $\phi$ of the launcher.

Although the total cost of the proposed electromagnetic munitions launcher will be about equal to that of one large nuclear powered aircraft carrier, its firepower (nuclear or non-nuclear) would far exceed that of a carrier—or even the combined firepower of all of the carriers in the entire U.S. Navy. Thus, the launcher would be an extremely cost effective weapon system. It should also be pointed out that after the launcher is constructed and put into operation, it can remain in operation without interruption essentially indefinitely. But carriers and ballistic missile submarines must be taken out of active operational service periodically for refurbishment and crew rotation. Moreover, the cost required to maintain the launcher operational will be much lower than that of operating a carrier. Since the cost effectiveness of the electromagnetic launcher is so high, several such launchers could be constructed and put into operation at remote sites located deep within the continental United States.

It is believed that the proposed electromagnetic launcher represents a revolutionary weapon system for delivering nuclear or non-nuclear munitions with pinpoint accuracy to any target on Earth—or in orbit above it. Unlike strategic bombers or large naval warships such as aircraft carrier task forces or missile carrying submarines, the electromagnetic launcher does not have to be transported anywhere before it can go into action. It could deliver virtually unending salvos of warheads in a matter of minutes to destroy any target, or group of targets, on a moment's notice. Clearly, no strategic (or tactical) aircraft, naval vessel or ICBM could match the reaction time and speed with which this weapon system could be put into action to destroy enemy targets. Moreover, due to the hypervelocity and small size of the individual warheads, the warheads would be virtually impossible to intercept and destroy before reaching their targets. The launcher itself would remain deep within the continental United States and made invulnerable to attack by an overwhelming concentration of defensive weapon systems extending for many miles in all directions.

Just as the conventional cannon revolutionized the art of warfare when it was introduced several centuries ago, the intercontinental electromagnetic cannon introduced herein will revolutionize the art of warfare in the future.

Although the preferred embodiment of the intercontinental electromagnagnetic cannon disclosed herein uses a discrete coil coaxial electromagnetic accelerator to accelerate the munitions, the munitions could also be accelerated by a large diameter "railgun" or some other electromagnetic accelerator that uses magnetic forces to accelerate objects. The detailed operating principles of these electromagnetic accelerators can be found in "Proceedings Of The Second Symposium on Electromagnetic Launchers," *IEEE Transactions On Magnetics*, Vol. MAG-20, No. 2, March 1984.

From the foregoing description, it will thus be evident that the present invention provides a vastly improved weapon system for delivering nuclear or nonnuclear warheads to targets located anywhere on, or in orbit above the Earth's surface. As various other embodiments, changes, variations and modifications can be made in all elements and operating methods of the system without departing from the spirit or scope of the invention, it is intended that all subject matter contained in the above description or shown in the accompanying drawings should be interpreted as illustrative and not in a limiting sense.

What is claimed is:

1. A weapon system for launching projectiles within the Earth's atmosphere to distant targets comprising:
- a projectile;
- an accelerating tube;
- means for evacuating said accelerating tube;
- an evacuated canister containing said projectile;
- means for transferring said projectile from said evacuated canister into said evacuated accelerating tube; and
- means for accelerating said projectile through said evacuated tube by electromagnetic forces to hit a distant target.

2. A system as set forth in claim 1 wherein said accelerating means comprises a discrete coil coaxial electromagnetic accelerator.

3. A system as set forth in claim 2 wherein said projectile comprises:
- a launching sabot;
- a plurality of superconducting dipole coils mounted coaxially along said sabot; and
- at least one warhead mounted inside said sabot.

4. A system as set forth in claim 3 further comprising a guidance system mounted on said warhead adapted for guiding said warhead to hit a preselected target.

5. A system as set forth in claim 4 wherein said evacuated canister comprises:
- a cryogenic cooling system for maintaining said superconducting dipole coils at cryogenic temperatures;
- thermal insulation means for restricting the flow of ambient heat into said evacuated canister; and
- electronic cable means mounted inside said canister detachably connected to said sabot for programming said guidance system with targeting information before said sabot is launched.

6. A system as set forth in claim 3 further comprising:
- a group of sabots containing different types of warheads; and
- an automatic selection and loading system wherein a sabot containing a certain type of warhead can be selected from said group and loaded into said launch tube.

7. A system as set forth in claim 1 also comprising means for mounting said accelerating means on a movable platform such that said tube can be pointed in various directions.

8. A system as set forth in claim 7 wherein said mounting means comprises:
- a rigid frame;
- means for mounting said accelerating means on said frame;
- an inner sphere;
- means for mounting said frame inside said inner sphere;
- an outer sphere mounted concentrically around said inner sphere;
- means for rotating said inner sphere around a horizontal axis passing through the center of said inner sphere; and
- means for rotating said outer sphere about a vertical axis passing through the center of said outer sphere such that said accelerating means can be pointed in various directions by rotating said inner sphere about said horizontal axis and by rotating said outer sphere about said vertical axis.

9. A system as set forth in claim 1 further comprising energy storage means for storing electrical energy for operating said accelerator means.

10. A system as set forth in claim 1 wherein said accelerating means further comprises means for varying the launch velocity of said projectile.

11. A system as set forth in claim 10 wherein said launch velocities are sufficiently high to enable said projectile to have unlimited range for hitting a target located anywhere on the Earth's surface.

12. A weapon system for launching a projectile through the atmosphere comprising:
- a projectile;
- an accelerating tube having an entrance and an end;
- an air-tight diaphragm mounted over the end of said tube;
- an air-tight door mounted adjacent said diaphragm at the end of said tube;
- means for introducing said projectile into the entrance of said tube;
- means for evacuating the interior of said tube;
- means for accelerating said projectile through said tube by electromagnetic force means;
- sensing means for automatically sensing when said projectile passes completely through said tube;
- door actuator means connected to said sensing means adapted for closing said door mounted at the end of said tube immediately after a projectile is launched in order to maintain a partial vacuum inside said tube after said projectile is launched;

means for automatically mounting another air-tight diaphragm over the end of said tube after said projectile is launched;

means for automatically introducing another projectile into said tube; and means for re-evacuating the partially evacuated tube.

13. A system as set forth in claim 12 wherein said means for re-evacuating said tube comprises:

a plurality of air evacuation ducts mounted along said tube;

a vacuum storage tank means;

a plurality of conduit means connecting said vacuum storage means to said air evacuation ducts adapted for transferring air out of said tube into said vacuum storage tank means; and a plurality of vacuum pump means connected to said vacuum storage tank means adapted for maintaining a high vacuum inside said vacuum storage tank means.

14. A system as set forth in claim 12 wherein said accelerating means comprises a discrete coil coaxial electromagnetic accelerator.

15. A system as set forth in claim 14 wherein said projectile comprises:

a launching sabot;

a plurality of superconducting dipole coils mounted coaxially along said sabot; and a plurality of warheads mounted inside said sabot.

16. A system as set forth in claim 15 further comprising a guidance system mounted on said warheads adapted for guiding said warheads to hit distant targets.

17. A system as set forth in claim 16 further comprising:

means for housing said sabot before said sabot is launched;

a cryogenic cooling system mounted inside said housing means adapted for maintaining said superconducting dipole coils at cryogenic temperatures;

thermal insulation mounted on said housing means for restricting the flow of ambient heat into said housing means; and electronic cable means mounted inside said housing means detachably connected to said sabot for programming said guidance system with targeting information before said sabot is launched.

18. A system as set forth in claim 15 further comprising:

a group of sabots containing different types of warheads; and an automatic selection and loading system wherein a sabot containing a certain type of warhead can be selected from said group and loaded into said launch tube.

19. A system as set forth in claim 12 also comprising means for mounting said accelerating means on a movable platform such that said tube can be pointed in various directions.

20. A system as set forth in claim 19 wherein said mounting means comprises:

a rigid frame;

means for mounting said accelerating means on said frame;

an inner sphere;

means for mounting said frame inside said inner sphere;

an outer sphere mounted concentrically around said inner sphere;

means for rotating said inner sphere around a horizontal axis passing through the center of said inner sphere; and means for rotating said outer sphere about a vertical axis passing through the center of said outer sphere such that said accelerating means can be pointed in various directions by rotating said inner sphere about said horizontal axis and by rotating said outer sphere about said vertical axis.

21. A system as set forth in claim 12 further comprising energy storage means for storing electrical energy needed for operating said accelerator means.

22. A system as set forth in claim 12 further comprising means for varying the launch velocity of said projectiles.

23. A system as set forth in claim 22 wherein said launch velocity is sufficiently high to enable said projectile to have unlimited range for hitting targets located anywhere on the Earth's surface.

24. A system for launching projectiles repetitively at high velocities within the Earth's atmosphere comprising:

an accelerating tube;

an evacuated air-tight canister;

a projectile mounted inside said evacuated canister;

an air-tight door mounted on the front of said evacuated canister;

an air-tight door mounted on the entrance of said tube;

an air-tight diaphragm mounted on the end of said tube;

means for evacuating said tube;

means for detachably mounting said evacuated canister on said tube such that said canister door and said tube entrance door are in contacting air-tight sealing engagement;

means for opening said canister door and said tube entrance door for providing an evacuated, air-tight passageway between said mounted canister and said evacuated tube;

means for injecting said projectile out of said canister into said tube;

means for closing said tube entrance door after said projectile is injected into said evacuated tube;

an air-tight door mounted at the end of said tube adjacent said diaphragm;

means for opening said air-tight door at the end of said tube before said projectile is launched;

means for accelerating said projectile through said evacuated tube by electromagnetic forces;

means for closing said air-tight door at the end of said tube immediately after said projectile is launched thereby limiting the amount of air that can enter the tube after said projectile is launched;

means for mounting another air-tight diaphragm over the end of said tube; and means for detaching the empty canister from the tube entrance and replacing it with a loaded canister so that another projectile can be launched.

25. A system as set forth in claim 24 wherein said means for re-evacuating said tube comprises:

a plurality of air evacuation ducts mounted through the walls of said tube;

a vacuum storage tank means;

conduit means connecting said vacuum storage tank means to said air evacuation ducts adapted for transferring air out of said tube and depositing it into said vacuum storage tank means; and a plurality of vacuum pump means connected to said vacuum storage tank means adapted for maintaining a high vacuum inside said tank means.

26. A system as set forth in claim 24 wherein said accelerating means comprises a discrete coil coaxial electromagnetic accelerator.

27. A system as set forth in claim 24 wherein said projectile comprises:

a reinforced cylindrical housing;

a streamlined nose cone mounted on the forward end of said housing;

a plurality of superconducting dipole coils mounted coaxially along the walls of said housing; and at least one warhead mounted inside said housing.

28. A system as set forth in claim 27 further comprising guidance means mounted on said warheads adapted for guiding said warheads to hit pre-selected targets.

29. A system as set forth in claim 28 wherein said evacuated storage canisters further comprises:

a cryogenic cooling system mounted inside said canisters adapted for maintaining said superconducting dipole coils at cryogenic temperatures;

thermal insulation means mounted on said canisters for restricting the flow of ambient heat into the interior of said canisters;

means for evacuating and maintaining the interior of said canisters in a vacuum environment after said projectiles are mounted inside them; and electronic cable means mounted inside said canisters detachably connected to said projectiles for programming said guidance systems on said warheads with targeting data before said projectiles are launched.

30. A system as set forth in claim 27 further comprising:

a group of canisters loaded with projectiles containing different types of warheads; and an automatic selection system whereby a canister containing a certain type of warhead can be selected from said group of loaded canisters and automatically positioned in front of entrance of said tube.

31. A system as set forth in claim 24 further comprising means for mounting said accelerating means on a movable platform such that said tube can be pointed in various directions.

32. A system as set forth in claim 31 wherein said mounting means comprises:

a rigid frame;

means for mounting said accelerating means on said frame;

an inner sphere;

means for rigidly mounting said frame inside said inner sphere;

an outer sphere mounted concentrically around said inner sphere;

means for rotating said inner sphere around a horizontal axis passing through the center of said inner sphere; and means for rotating said outer sphere about a vertical axis passing through the center of said outer sphere such that said accelerating means can be pointed in various directions by rotating said inner sphere about said horizontal axis and by rotating said outer sphere about said vertical axis.

33. A system as set forth in claim 24 further comprising energy storage means for storing electrical energy needed for operating said accelerator means.

34. A system as set forth in claim 24 further comprising means for varying the launch velocity of said projectiles, said velocities having sufficiently high values to enable said projectiles to have unlimited range for reaching any location on the Earth's surface, or for injecting the projectiles onto Earth escape trajectories.

35. A method for launching projectiles repetitively at high velocities within the Earth's atmosphere to distant targets comprising the steps of:

mounting said projectiles inside evacuated canisters;

transferring a projectile from an evacuated canister into an evacuated launch tube;

accelerating said transferred projectile through an evacuated launch tube by means of electromagnetic forces; and maintaining a partial vacuum inside said evacuated tube after said projectile is launched by closing an air-tight door mounted at the end of said tube immediately after said projectile is launched thereby allowing said transferring and accelerating steps to operate repetitively without having to completely re-evacuate said tube after each launch.

36. A method as set forth in claim 35 wherein said accelerating step comprises the steps of:

mounting magnetic dipole means on said projectiles;

mounting a plurality of spaced-apart coaxial drive coils around said evacuated tube;

connecting said drive coils to a like plurality of charged high voltage capacitors; and sequentially discharging said capacitors into said drive coils when a projectile passes by thereby generating accelerating forces on dipole coils mounted on said projectile.

37. A method as set forth in claim 36 further comprising the step of maintaining said projectile in the center of said evacuated tube while said projectile is accelerated through it by magnetic forces.

38. A method as set forth in claim 36 further comprising the steps of:

mounting at least one warhead inside said projectile;

mounting guidance means on each warhead mounted inside said projectile; and releasing said warheads from said projectile after said projectile passes out of the Earth's atmosphere such that each warhead is guided to a preselected target by its own guidance system.

39. A method as set forth in claim 38 wherein said magnetic dipole means comprises superconducting dipole coils further comprising the steps of:

mounting a cryogenic cooling system inside said canisters for maintaining said superconducting dipole coils at cryogenic temperatures prior to launch;

mounting thermal insulation means on said canisters to restrict the flow of ambient heat into said canisters;

maintaining a vacuum environment inside said canisters; and mounting a plurality of electric cables inside said canisters that are detachably connected to said projectiles for allowing targeting information to be fed into said guidance systems before a projectile is launched.

40. A method as set forth in claim 35 further comprising the steps of:

providing a group of projectiles loaded with different types of warheads;

selecting a projectile from said group that contains a certain type of warhead; and loading said selected projectile into said evacuated tube.

41. A method as set forth in claim 35 further comprising the step of mounting said accelerating means on a movable platform such that said projectiles can be launched in various directions.

42. A method as set forth in claim 41 wherein said mounting step comprises the steps of:

mounting said accelerating means on a frame;

mounting said frame inside an inner sphere;

mounting said inner sphere concentrically inside an outer sphere such that said inner sphere can be rotated about a horizontal axis passing through the center of said inner sphere; and mounting said outer sphere such that it can be rotated about a vertical axis passing through the center of said outer sphere so that said accelerating means can be pointed in various directions by rotating said inner sphere about said horizontal axis and by rotating said outer sphere about said vertical axis.

43. A method as set forth in claim 35 further comprising the step of storing the electrical energy used for said accelerating step inside an energy storage system.

44. A method as set forth in claim 35 further comprising the step of varying the launch velocity of said projectile for hitting targets at various ranges from the launcher, said launch velocities sufficiently high to enable said projectile to have unlimited range for hitting targets located anywhere on the Earth's surface, or to launch said projectiles on Earth escape trajectories.

45. A method as set forth in claim 44 further comprising the step of launching a group of projectiles containing various warheads on various ballistic trajectories designed to enable said warheads to all arrive and detonate at preselected targets simultaneously.

46. A method for launching projectiles repetitively at high velocities through an evacuated tube within the Earth's atmosphere comprising the steps of:

mounting said projectiles inside evacuated, air-tight canisters;

mounting an air-tight door on the front of said canisters;

mounting an air-tight door on the entrance of said tube;

mounting a thin air-tight diaphragm across the end of said tube;

evacuating said tube to a low pressure;

mounting an air-tight canister on said tube such that said canister door and said tube door are in contacting air-tight sealing engagement;

opening said canister door and said tube entrance door for providing an evacuated air-tight passageway between said evacuated canister and said evacuated tube;

injecting the projectile that is inside said mounted canister, into said evacuated tube;

accelerating said projectile through said evacuated tube by means of electromagnetic forces;

closing an air-tight door mounted adjacent said diaphragm immediately after said projectile is launched thereby restricting the amount of air that can enter said tube after said projectile is launched;

re-evacuating said tube after said projectile is launched;

mounting another air-tight diaphragm on the end of said tube; and detaching the empty canister from the tube entrance and replacing it with a loaded canister so that another projectile can be launched in a repetitive operation.

47. A method as set forth in claim 46 wherein said step of re-evacuating said tube comprises:

mounting a plurality of air evacuation ducts through the walls of said tube;

providing a vacuum storage tank means;

connecting said vacuum storage tank means to said air evacuation ducts for transferring air out of said tube and depositing it into said vacuum storage tank means; and maintaining a high vacuum inside said vacuum storage tank by pumping means.

48. A method as set forth in claim 46 wherein said accelerating step comprises the steps of:

mounting magnetic dipole coil means on said projectiles;

mounting a plurality of spaced-apart coaxial drive coils around said evacuated tube;

connecting said drive coils to a like plurality of charged high voltage capacitors; and sequentially discharging said capacitors into said drive coils as said projectile passes by thereby generating accelerating forces on dipole coils mounted on said projectile.

49. A method as set forth in claim 48 further comprising the step of maintaining said projectile in the center of said evacuated tube while said projectile is accelerated by magnetic forces.

50. A method as set forth in claim 48 wherein said magnetic dipole means mounted on said projectile comprises a plurality of superconducting dipole coils mounted coaxially along said projectile further comprising the steps of:

mounting a cryogenic cooling system inside said canisters for maintaining said superconducting dipole coils at cryogenic temperatures; and mounting thermal insulation means on said canisters for restricting the flow of ambient heat to said canisters.

51. A method as set forth in claim 46 further comprising the steps of:

mounting at least one warhead inside said projectile;

mounting guidance system means on each warhead mounted inside said projectiles;

withdrawing said warheads from a projectile after said projectile is launched and passes out of the Earth's atmosphere; and guiding each individual warhead, after said warheads are withdrawn from said projectile, to follow precise pre-calculated trajectories to hit preselected targets by means of said guidance systems.

52. A method as set forth in claim 51 further comprising the step of mounting a plurality of electric cables inside said canisters that are detachably connected to the projectiles mounted inside them for allowing targeting data to be fed into the guidance system of each warhead before said projectiles are launched.

53. A method as set forth in claim 51 further comprising the steps of:

providing a group of canisters loaded with different types of warheads designed for destroying different types of targets;

selecting a canister from said group that contains a certain type of warhead;

mouting said canister on said tube;

injecting the projectile loaded with desired warheads into said tube; and launching said projectile through said tube.

54. A method as set forth in claim 46 further comprising the step of mounting said accelerating means on a movable platform such that said projectiles can be launched in various directions.

55. A method as set forth in claim 54 wherein said mounting step comprises the steps of:

mounting said accelerating means on a frame;

mounting said frame inside an inner sphere;

mounting said inner sphere concentrically inside an outer sphere such that said inner sphere can be rotated about a horizontal axis passing through the center of said inner sphere; and mounting said outer sphere such that it can be rotated about a vertical axis passing through the center of said outer sphere so that said accelerating means can be pointed in various directions by rotating said inner sphere about said horizontal axis and by rotating said outer sphere about said vertical axis.

56. A method as set forth in claim 46 further comprising the step of storing electrical energy used for said accelerating step inside an energy storage system.

57. A method as set forth in claim 46 further comprising the step of controlling the launch velocity of said projectiles for hitting targets with various distances from the launcher, said launch velocities being sufficiently high to enable said projectile to have unlimited range for hitting targets located anywhere on the Earth's surface or for launching said projectiles on Earth escape trajectories.

58. A method as set forth in claim 57 further comprising the step of launching a group of projectiles containing multiple independently targetable warheads at different launch times on different trajectories designed to enable said warheads to all arrive and detonate at preselected targets simultaneously.

59. A method for launching a projectile through an evacuated tube comprising the steps of:

mounting an air-tight door on the entrance of said tube;

mounting said projectile inside an air-tight canister;

mounting an air-tight door on said canister;

evacuating said canister;

mounting said evacuated canister in air-tight sealing engagement on the end of said tube such that said tube door and said canister door are adjacent each other;

opening said tube door and said canister door for providing an air-tight passageway between said evacuated canister and said evacuated tube;

injecting said projectile into said evacuated tube and;

accelerating said projectile through said evacuated tube by means of electromagnetic forces.

60. A system for launching a projectile through an evacuated tube comprising:

a tube;

means for evacuating said tube;

an air-tight door mounted on the entrance of said tube;

a projectile;

an air-tight canister;

an air-tight door mounted on the front of said canister;

means for mounting said projectile inside said canister;

means for evacuating said canister;

means for mounting said evacuated canister in air-tight sealing engagement on the entrance of said tube such that said tube entrance door is adjacent said canister door;

means for opening said tube door and said canister door for providing an air-tight passageway between said evacuated canister and said evacuated tube;

means for injecting said projectile out of said canister into said evacuated tube; and means for accelerating said projectile through said evacuated tube by electromagnetic forces.

* * * * *